US007266315B2

(12) United States Patent
Sato

(10) Patent No.: US 7,266,315 B2
(45) Date of Patent: Sep. 4, 2007

(54) IMAGE FORMING APPARATUS AND IMAGE STABILIZATION PROCESSING METHOD

(75) Inventor: Akihiko Sato, Katsushika-ku (JP)

(73) Assignee: Canon Kabushiki Kaisha (JP)

( * ) Notice: Subject to any disclaimer, the term of this patent is extended or adjusted under 35 U.S.C. 154(b) by 239 days.

(21) Appl. No.: 11/069,135

(22) Filed: Mar. 1, 2005

(65) Prior Publication Data

US 2005/0191068 A1 Sep. 1, 2005

(30) Foreign Application Priority Data

Mar. 1, 2004 (JP) ..... 2004-056526

(51) Int. Cl.
*G03G 15/00* (2006.01)

(52) U.S. Cl. ..... 399/38; 399/75; 399/82; 399/85

(58) Field of Classification Search ..... 399/38, 399/54, 75, 82, 85, 88, 223, 227
See application file for complete search history.

(56) References Cited

U.S. PATENT DOCUMENTS 6,047,146 A * 4/2000 Ito et al. ..... 399/54
6,701,110 B2 * 3/2004 Ono ..... 399/227
6,788,907 B1 * 9/2004 Burkes et al. ..... 399/82
6,975,819 B2 * 12/2005 Katamoto ..... 399/82

FOREIGN PATENT DOCUMENTS

JP 2002-44309 A 2/2002
JP 2003-167394 A 6/2003

* cited by examiner

*Primary Examiner*—William J. Royer
(74) *Attorney, Agent, or Firm*—Rossi, Kimms & McDowell LLP

(57) ABSTRACT

An image forming apparatus reduces the wait time before completion of an image stabilization process executed for preparation for image formation while ensuring image quality. In the image forming apparatus, image formation is performed using developers having four colors respectively (yellow, magenta, cyan, and black). The image forming apparatus has a monochrome mode in which only black color is used, a full color mode in which four colors are used and an automatic color selection (ACS) mode in which one of the monochrome mode and the full color mode is selected by automatically recognizing image data and image formation is carried out in the selected mode. One of the monochrome mode, the full color mode, and the ACS mode is set to a default mode upon turning on the image forming apparatus. The image stabilization process is then executed based on the default mode.

27 Claims, 12 Drawing Sheets

*FIG. 12*

| COLOR SETTING AT STARTUP | ITEMS OF IMAGE STABILIZATION PROCESS TO BE EXECUTED |
|---|---|
| BK | Dmax(BK) |
| | Dhalf(BK) |
| | PRIMARY ATVC (BK) |
| | PATCH SENSOR-BASED DENSITY MEASUREMENT AND TARGET CORRECTION (BK) |
| COLOR | Dmax(Y/M/C/BK) |
| | Dhalf(Y/M/C/BK) |
| | PRIMARY ATVC (BK) |
| | PRIMARY ATVC (Y/M/C/BK) |
| | PATCH SENSOR-BASED DENSITY MEASUREMENT AND TARGET CORRECTION (Y/M/C/BK) |
| | DEVELOPER DENSITY MEASUREMENT & TARGET CORRECTION (Y/M/C) |
| ACS | Dmax(Y/M/C/BK) |
| | Dhalf(Y/M/C/BK) |
| | PRIMARY ATVC (BK) |
| | PRIMARY ATVC (Y/M/C/BK) |
| | PATCH SENSOR-BASED DENSITY MEASUREMENT AND TARGET CORRECTION (Y/M/C/BK) |
| | DEVELOPER DENSITY MEASUREMENT & TARGET CORRECTION (Y/M/C) |

IMAGE FORMING APPARATUS AND IMAGE STABILIZATION PROCESSING METHOD

BACKGROUND OF THE INVENTION

1. Field of the Invention

The present invention relates to an image forming apparatus and an image stabilization processing method, which are capable of forming monochrome or color images using an electrophotographic printing method, and more particularly to an image forming apparatus and an image stabilization processing method, which are applicable to copying machines, printers, facsimile machines, and multi-function machines provided with a copying function, a printing function, and a facsimile function.

2. Description of the Related Art

Conventionally, color copying machines and color printers (color machines) installed in company offices and the like, for printing out color documents have been potentially in great demand, but the machine prices and running costs thereof are so high that they cannot be readily or freely used like monochrome copying machines or monochrome printers (monochrome machines). This is also because most business documents are printed out in monochrome and therefore the demand for color printing of business documents has been low, so that there have been few color copying machines and color printers which are provided by manufacturers at low machine prices and with low running costs, and yet profitable enough for the manufacturers in spite of the low user demand for color printing output.

However, in recent years, there have been developed color copying machines and color printers for office use which have realized substantially the same machine prices and running costs as those of the monochrome machines and therefore permit users to feel free to carry out color printout in offices, thereby promoting a shift to color printing. With this development, color machines are replacing conventional monochrome machines in offices.

Under the circumstances, a technique has been proposed in which calibration processing for density correction is executed on four color toner images necessary for color image formation, when the power of the color machine is turned on (see e.g. Japanese Laid-Open Patent Publication (Kokai) No. 2003-167394).

On the other hand, a control method for multi-function machines has been also proposed in which upon power-on of the machine, if the initial setup screen has been set to a facsimile mode screen, an image stabilization process for correction of image processing parameters is not executed but executed after printing is performed (see e.g. Japanese Laid-Open Patent Publication (Kokai) No. 2002-44309). This control method is based on the concept that even with multi-function machines, facsimile printing is generally carried out in monochrome, and therefore image quality is not particularly affected even if the image stabilization process is not executed immediately after the start of the machine, which is initially set to a facsimile mode.

However, in the case of color machines including the color machine described above, calibration processing for density correction needs to be executed on the four color toner images necessary for color image formation. In general, the calibration processing is often executed immediately after power-on as described in Japanese Laid-Open Patent Publication (Kokai) No. 2003-167394. For this reason, adjustment time immediately after power-on becomes much longer in color machines than in monochrome machines. In addition, the color machines make preparations for color output even when only monochrome output is intended to be used, so that users are kept waiting due to adjustment for unnecessary color output.

Further, when color machines employ a two-component developing method using toner and carrier, toner density markedly changes depending on the environment. For this reason, immediately after the first power-on in the morning, or immediately after return from a power-saving mode, when environmental changes are most likely to occur, a plurality of processes, such as toner density measurement and density gradation correction, are necessitated, which tends to increase time required for processing executed during a wait.

The control method described in Japanese Laid-Open Patent Publication (Kokai) No. 2002-44309 has been proposed as a solution to the problem that adjustment time immediately after power-on is longer in color machines than in monochrome machines.

In this case, however, even if the initial setup screen has been set to the facsimile mode screen, and facsimile printing is to be performed in monochrome, when the environment has largely changed after the previous image stabilization process, degradation of image quality can occur, which necessitates resetting of image processing parameters. Further, a user can switch the facsimile mode screen to the copy mode screen for color printout, and hence color printout can be performed without execution of the image stabilization process. In such a case, image quality cannot be ensured.

SUMMARY OF THE INVENTION

It is an object of the present invention to provide an image forming apparatus and an image stabilization processing method, which make it possible to reduce wait time before completion of an image stabilization process executed for preparation for image formation, and at the same time ensure image quality.

To attain the above object, in a first aspect of the present invention, there is provided an image forming apparatus which has an image forming section that uses a plurality of developers having respective different predetermined colors. The image forming section has a first mode in which the image forming section uses only a predetermined one of the predetermined colors of the developers, a second mode in which the image forming section uses all of the predetermined colors, and a third mode in which one of the first mode and the second mode is selected by automatically recognizing image data and the image forming section carries out the selected mode. A default setting section sets one of the first mode, the second mode, and the third mode to a default mode to be applied when power of the image forming apparatus is turned on. Additionally, a controller determines the default mode set by the default setting section when the power of the image forming apparatus is turned on. When the set default mode is the first mode, the controller causes an image stabilization process necessary for preparation for image formation to be executed only for the predetermined color used in the first mode. When the set default mode is the second mode or the third mode, the controller causes the image stabilization process necessary for preparation for image formation to be executed for all the predetermined colors used in the second mode.

With the arrangement of the image forming apparatus according to the first aspect of the present invention, immediately after the power is turned on, if the image stabilization process is necessary for preparation for image formation to be executed in a set color mode, image stabilization processes specific to the set color mode are selected and executed. As a result, only the image stabilization processes necessary for the color set to the color mode are executed, and hence the wait time before completion of the image stabilization process for preparation for image formation can be reduced. Further, since the image stabilization process is executed according to the set color mode, the quality of images to be printed out can be ensured.

Preferably, when the power of the image forming apparatus is turned on the controller determines whether or not the image stabilization process needs to be executed for preparation for image formation corresponding to the determined default mode. When the controller determines that the image stabilization process needs to be executed, it causes the image stabilization process to be executed for the predetermined color or colors associated with the default mode.

Preferably, when the power of the image forming apparatus is turned on the controller determines whether or not the image stabilization process needs to be executed for preparation for image formation corresponding to the determined default mode, and when determining that the image stabilization process need not be executed, inhibits the image stabilization process from being executed for the predetermined color or colors associated with the default mode.

Preferably, the default mode set when the power of the image forming apparatus is turned on is the first mode, and thereafter, a job in the second mode is input. The controller causes the image stabilization process to be executed for all the predetermined colors including the predetermined color used in the first mode and involved in the image stabilization process executed when the power of the image forming apparatus was turned on.

Preferably, the image stabilization process is one or more of either a maximum toner density correction process for maintaining a maximum toner density, a gradation correction process for maintaining halftone gradation characteristics, a target toner density value correction process for maintaining a toner density at a target value, and a transfer high voltage setting process for setting a transfer high voltage for toner transfer.

With this arrangement of the preferred embodiment, after executing an image stabilization process when the power is turned on, for a monochrome mode in which image formation is performed using a single color, if a job is input in a color mode in which image formation is performed using a plurality of colors, an image stabilization process is executed for all the colors including the single color of the monochrome mode for which the image stabilization process has been executed when the power is turned on. This ensures the quality of images printed out.

Preferably, when the first mode is set to the default mode when the power of the image forming apparatus is turned on and a job in the second mode is input immediately after execution of the image stabilization process for the predetermined color used in the first mode, the controller executes the image stabilization process for the predetermined colors used in the second mode and other than the predetermined color used in the first mode.

With the arrangement of this preferred embodiment, after executing an image stabilization process when the power is turned on for a monochrome mode, if a job is input in a color mode in which image formation is performed using a plurality of colors, an image stabilization process is executed for the colors exclusive of the single color of the monochrome mode for which the image stabilization process has been executed upon turn-on of the power. This reduces the wait time before completion of the image stabilization process.

To attain the above object, in a second aspect of the present invention, there is provided an image forming apparatus which has an image forming section that uses a plurality of developers having an N number (N=1, . . . , n: integer) of colors, respectively, the image forming section having a first mode that uses only a predetermined one (N=1) of the N number of colors of the developers, a second mode in which the image forming section uses all predetermined colors (N=n) of the N number of colors, a third mode in which one of the first mode and the second mode is selected by automatically recognizing image data and the image forming section uses the selected mode, and a fourth mode in which the image forming section uses an integer M number of colors out of the N number of colors, the integer being within a range of 1<M<n. A default setting section sets one of the first mode, the second mode, the third mode, and the fourth mode to a default mode to be applied when power of the image forming apparatus is turned on, and a controller determines the default mode set by the default setting section when the power of the image forming apparatus is turned on. The controller is operable when the set default mode is the first mode and causes an image stabilization process necessary for preparation for image formation to be executed only for the predetermined color used in the first mode. The controller is additionally operable when the set default mode is the second mode or the third mode and causes the image stabilization process necessary for preparation for image formation to be executed for all the predetermined colors used in the second mode. The controller is also operable when the set default mode is the fourth mode and causes the image stabilization process necessary for preparation for image formation to be executed for the integer M number (within the range of 1<M<n) of colors used in the fourth mode.

Preferably, the image stabilization process includes at least one of a maximum toner density correction process for maintaining a maximum toner density, a gradation correction process for maintaining halftone gradation characteristics, a target toner density value correction process for maintaining a toner density at a target value, and a transfer high voltage setting process for setting a transfer high voltage for toner transfer.

To attain the above object, in a third aspect of the present invention, there is provided an image forming apparatus which has an image forming section that uses a plurality of developers having an N number (N=1, . . . , n: integer) of colors, respectively. The image forming section has a first mode which uses only a predetermined one (N=1) of the N number of colors of the developers, a second mode which uses all predetermined colors (N=n) of the N number of colors, a third mode which uses an integer M number of colors out of the N number of colors, the integer being within a range of 1<M<n, and a fourth mode in which one of the first mode and the second mode is selected by automatically recognizing image data and the image forming section uses the selected mode. A default setting section sets one of the first mode, the second mode, the third mode, and the fourth mode to a default mode to be applied when power of the image forming apparatus is turned on. A controller determines the default mode set by the default setting section when the power of the image forming apparatus is turned on. When the set default mode is the first mode, the controller causes an image stabilization process necessary for preparation for image formation to be executed only for the predetermined color used in the first mode. When the set default mode is the second mode, the controller causes the image stabilization process necessary for preparation for image formation to be executed for all the predetermined colors used in the second mode. When the set default mode is the third mode, the controller causes the image stabilization process necessary for preparation for image formation to be executed for the integer M number (within the range of 1<M<n) of colors used in the third mode. When the set default mode is the fourth mode, the controller causes the image stabilization process necessary for preparation for image formation to be executed for all the predetermined colors or the integer M number (within the range of 1<M<n) of colors used in the second mode or the third mode.

Preferably, the default setting section is capable of further setting one of the second mode and the third mode as the fourth mode.

Preferably, the image stabilization process includes at least one of a maximum toner density correction process for maintaining a maximum toner density, a gradation correction process for maintaining halftone gradation characteristics, a target toner density value correction process for maintaining a toner density at a target value, and a transfer high voltage setting process for setting a transfer high voltage for toner transfer.

To attain the above object, in a fourth aspect of the present invention, there is provided an image forming apparatus which has an image forming section that uses a plurality of developers having respectively different predetermined colors. The image forming section has a first mode which uses only a predetermined one of the predetermined colors of the developers, and a second mode which uses at least two of the predetermined colors. A default setting section sets one of the first mode or the second mode to be applied when power of the image forming apparatus is turned on. Additionally, a controller determines the default mode set by the default setting section when the power of the image forming apparatus is turned on, and determines whether or not an image stabilization process needs to be executed for preparation for image formation corresponding to the set default mode. When it is determined that the image stabilization process needs to be executed, the controller causes the image stabilization process to be executed for the predetermined color or colors associated with the default mode.

Preferably, the image stabilization process includes at least one of a maximum toner density correction process for maintaining a maximum toner density, a gradation correction process for maintaining halftone gradation characteristics, a target toner density value correction process for maintaining a toner density at a target value, and a transfer high voltage setting process for setting a transfer high voltage for toner transfer.

Preferably, the image forming section further includes a third mode in which one of the first mode and the second mode is selected by automatically recognizing whether image to be output is in monochrome or in color and the image forming section uses the selected mode.

To attain the above object, in a fifth aspect of the present invention, there is provided an image forming apparatus which has an image forming section that uses a plurality of developers having respectively different predetermined colors. The image forming section has a first mode that uses only a predetermined one of the predetermined colors of the developers and a second mode that uses at least two of the predetermined colors. A default setting section sets one of the first mode or the second mode to be applied when power of the image forming apparatus is turned on, and a controller determines the default mode set by the default setting section when the power of the image forming apparatus is turned on. The controller additionally determines whether or not an image stabilization process need not be executed for preparation for image formation corresponding to the set default mode. When it is determined that the image stabilization process needs to be executed, the controller inhibits the image stabilization process from being executed for the predetermined color or colors associated with the default mode.

Preferably, the image stabilization process includes at least one of a maximum toner density correction process for maintaining a maximum toner density, a gradation correction process for maintaining halftone gradation characteristics, a target toner density value correction process for maintaining a toner density at a target value, and a transfer high voltage setting process for setting a transfer high voltage for toner transfer.

Preferably, the image forming section further includes a third mode in which one of the first mode and the second mode is selected by automatically recognizing whether the image to be output is in monochrome or in color and the image forming section uses the selected mode.

To attain the above object, in a sixth aspect of the present invention, there is provided an image forming apparatus which has an image forming section that uses a plurality of developers having respective different predetermined colors. The image forming section has a first mode which uses only a predetermined one of the predetermined colors of the developers, and a second mode which uses at least two of the predetermined colors. A default setting section sets one of the first mode or the second mode to be applied when power of the image forming apparatus is turned on. Additionally, a controller determines the default mode set by the default setting section when the power of the image forming apparatus is turned on, and determines timing for starting an image stabilization process for preparation for image formation for the predetermined color or colors associated with the default mode.

Preferably, the image forming apparatus includes a fixing section that carries out fixing, and the image forming section includes a monitoring section for monitoring a fixing temperature of the fixing section. The controller changes a value of the fixing temperature for determining the timing for starting the image stabilization process, depending on the default mode set when the power of the image forming apparatus is turned on.

With the arrangement of this preferred embodiment, the fixing temperature of the fixing section is monitored, and a value of the fixing temperature set, for determining the timing for starting the image stabilization process, and is changed according to the set color mode. As a result, it is possible to further reduce the wait time before completion of the image stabilization process.

Preferably, the image stabilization process includes at least one of a maximum toner density correction process for maintaining a maximum toner density, a gradation correction process for maintaining halftone gradation characteristics, a target toner density value correction process for maintaining a toner density at a target value, and a transfer high voltage setting process for setting a transfer high voltage for toner transfer.

Preferably, the image forming section further includes a third mode in which one of the first mode and the second mode is selected by automatically recognizing whether image to be output is in monochrome or in color and image formation is carried out in the selected mode.

To attain the above object, in a seventh aspect of the present invention, there is provided an image stabilization processing method for an image forming apparatus which includes performing an image forming step of performing image formation using a plurality of developers having respective different predetermined colors. The image forming step has a first mode in which image formation is carried out using only a predetermined one of the predetermined colors of the developers, a second mode in which image formation is carried out using all of the predetermined colors, and a third mode in which one of the first mode and the second mode is selected by automatically recognizing image data and image formation is carried out in the selected mode. Further, a default setting step sets one of the first mode, the second mode, and the third mode to a default mode to be applied when power of the image forming apparatus is turned on. An executing step determines the default mode set in the default setting step when the power of the image forming apparatus is turned on, causing an image stabilization process necessary for preparation for image formation to be executed only for the predetermined color used in the first mode when the set default mode is the first mode, and causing the image stabilization process necessary for preparation for image formation to be executed for all the predetermined colors used in the second mode when the set default mode is the second mode or the third mode.

To attain the above object, in an eighth aspect of the present invention, there is provided an image stabilization processing method for an image forming apparatus, which includes performing an image forming step of performing image formation using a plurality of developers having a number (N=1, . . . , n: integer) of colors, respectively. The image forming step has a first mode in which image formation is carried out using only a predetermined one (N=1) of the N number of colors of the developers, a second mode in which image formation is carried out using all predetermined ones (N=n) of the N number of colors, a third mode in which one of the first mode and the second mode is selected by automatically recognizing image data and image formation is carried out in the selected mode, and a fourth mode in which image formation is carried out using an integer M number of colors out of the N number of colors, the integer lying within a range of 1<M<n. Additionally, there is a default setting step of setting one of the first mode, the second mode, the third mode and the fourth mode to a default mode to be applied when power of the image forming apparatus is turned on. Further, the method includes performing an executing step of determining the default mode set in the default setting step when the power of the image forming apparatus is turned on. The executing step includes executing an image stabilization process necessary for preparation for image formation only for the predetermined color used in the first mode when the set default mode is the first mode. Further, the executing step executes the image stabilization process necessary for preparation for image formation for all the predetermined colors used in the second mode when the set default mode is the second mode or the third mode. When the set default mode is the fourth mode, the executing step executes the image stabilization process necessary for preparation for image formation to be executed for the integer M number (within the range of 1<M<n) of colors used in the fourth mode.

To attain the above object, in a ninth aspect of the present invention, there is provided an image stabilization processing method for an image forming apparatus that performs an image forming step using a plurality of developers having a number (N=1, . . . , n: integer) of colors, respectively. The image forming step has a first mode which uses only a predetermined one (N=1) of the N number of colors of the developers, a second mode in which uses all predetermined ones (N=n) of the N number of colors, a third mode which uses an integer M number of colors out of the N number of colors, the integer being within a range of 1<M<n, and a fourth mode in which one of the first mode, the second mode, and the third mode is selected by automatically recognizing image data, and image formation is carried out in the selected mode. The method further includes a default setting step of setting one of the first mode, the second mode, the third mode, and the fourth mode to a default mode to be applied when power of the image forming apparatus is turned on. Additionally, the method includes an executing step of determining the default mode set in the default setting step when the power of the image forming apparatus is turned on, causing an image stabilization process necessary for preparation for image formation to be executed only for the predetermined color used in the first mode when the set default mode is the first mode, causing the image stabilization process necessary for preparation for image formation to be executed for all the predetermined colors used in the second mode when the set default mode is the second mode, causing the image stabilization process necessary for preparation for image formation to be executed for the integer M number (within the range of 1<M<n) of colors used in the third mode when the set default mode is the third mode, and causing the image stabilization process necessary for preparation for image formation to be executed for all the predetermined colors or the integer M number (within the range of 1<M<n) of colors used in the second mode or the third mode.

To attain the above object, in a tenth aspect of the present invention, there is provided an image stabilization processing method for an image forming apparatus, which has an image forming step of performing image formation using a plurality of developers having respective different predetermined colors. The image forming step has a first mode in which image formation is carried out using only a predetermined one of the predetermined colors of the developers, and a second mode in which image formation is carried out using at least two of the predetermined colors. A default setting step sets one of the first mode or the second mode to be applied when power of the image forming apparatus is turned on. An executing step determines the default mode set in the default setting step when the power of the image forming apparatus is turned on and determines whether or not an image stabilization process needs to be executed for preparation for image formation corresponding to the set default mode. The executing step additionally causes the image stabilization process to be executed for the predetermined color or colors associated with the default mode when it is determined that the image stabilization process needs to be executed.

To attain the above object, in an eleventh aspect of the present invention, there is provided an image stabilization processing method for an image forming apparatus, which has an image forming step of performing image formation using a plurality of developers having respectively different predetermined colors. The image forming step has a first mode in which image formation is carried out using only a predetermined one of the predetermined colors of the developers and a second mode in which image formation is carried out using at least two of the predetermined colors. A default setting step sets one of the first mode or the second mode to be applied when power of the image forming apparatus is turned on. An executing step further determines the default mode set in the default setting step when the power of the image forming apparatus is turned on, and determines whether or not an image stabilization process needs to be executed for preparation for image formation corresponding to the set default mode, and inhibits the image stabilization process from being executed for the predetermined color or colors associated with the default mode when determining that the image stabilization process need not be executed.

To attain the above object, in a twelfth aspect of the present invention, there is provided an image stabilization processing method for an image forming apparatus, which has an image forming step of performing image formation using a plurality of developers having respectively different predetermined colors. The image forming step has a first mode in which image formation is carried out using only a predetermined one of the predetermined colors of the developers, and a second mode in which image formation is carried out using at least two of the predetermined colors. A default setting step sets one of the first mode or the second mode to be applied when power of the image forming apparatus is turned on. An executing step determines the default mode set in the default setting step when the power of the image forming apparatus is turned on, and also determines the timing for starting an image stabilization process for preparation for image formation for the predetermined color or colors associated with the default mode.

The above and other objects, features, and advantages of the invention will become more apparent from the following detailed description taken in conjunction with the accompanying drawings.

BRIEF DESCRIPTION OF THE DRAWINGS

FIG. 10 is a flowchart of a color mode-by-color mode image stabilization process executed when the power of the image forming apparatus in FIG. 1 is turned on;

FIG. 12 is a diagram showing examples of color mode-specific sets of items of the image stabilization process executed for respective color modes set when the power of the image forming apparatus in FIG. 1 is turned on.

DETAILED DESCRIPTION OF THE PREFERRED EMBODIMENTS

The present invention will now be described in detail with reference to the drawings showing a preferred embodiment thereof.

Figure 1:
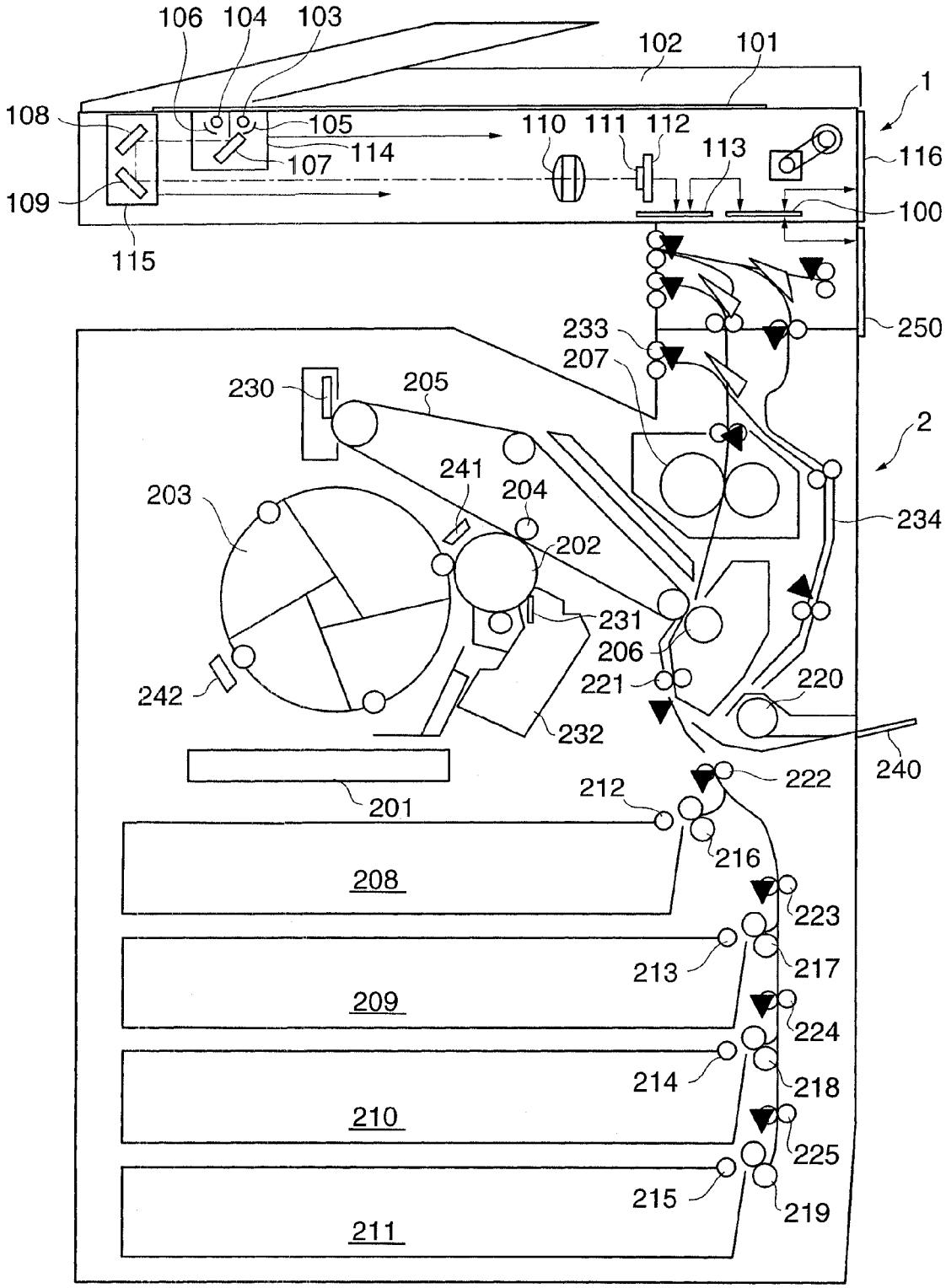
FIG. 1 is a diagram schematically showing the arrangement of an image forming apparatus according to an embodiment of the present invention.

FIG. 1 is a diagram schematically showing the arrangement of an image forming apparatus according to an embodiment of the present invention.

The image forming apparatus in FIG. 1 is configured as a multi-function machine equipped with a copying function, a printer function, and a facsimile function, and is capable of forming full-color images.

The image forming apparatus is comprised of a digital color image reader section 1 forming the upper part of a casing and a digital color image printer section 2 forming the lower part of the casing.

First, a description will be given of the arrangement of the digital color image reader section 1. The arrangement of the digital color image printer section 2 will be described after description with reference to FIGS. 2 and 3.

Figure 2:
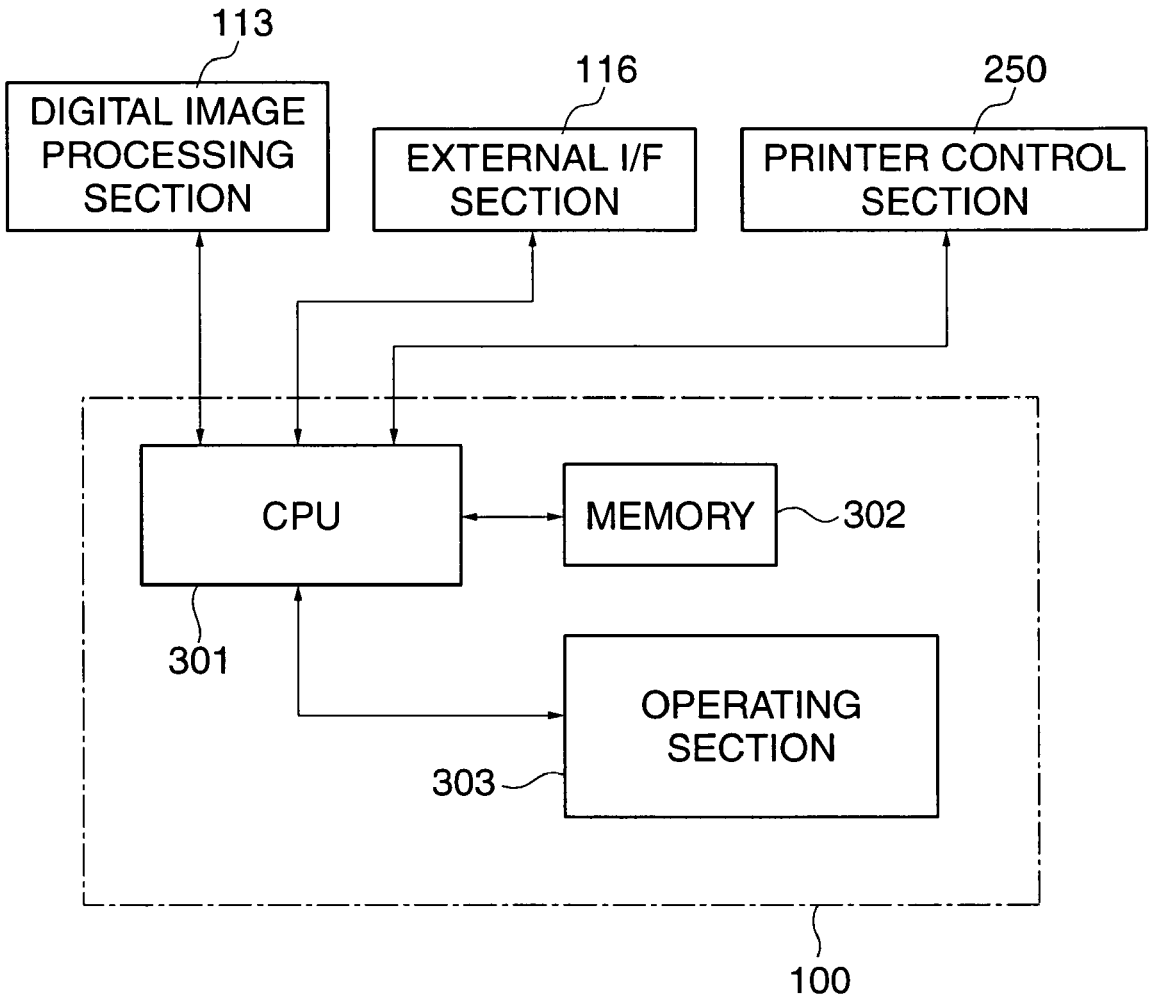
FIG. 2 is a block diagram showing the configuration of a control section and other sections associated therewith, appearing in FIG. 1.

A control section 100 is configured as shown in FIG. 2 to control the overall operation of the image forming apparatus. An automatic original feeder (ADF) 102 automatically feeds originals onto an original platen glass 101. The image forming apparatus may be provided with a mirror pressure plate, not shown, or a white pressure plate, not shown, in place of the automatic original feeder 102.

Light sources 103 and 104, which illuminate the original, are implemented by halogen lamps, fluorescent lamps, xenon lamps, or the like. Reflectors 105 and 106 converge light from the light sources 103 and 104 onto the original. Mirrors 107 to 109 guide reflected light and transmitted light from the original. A carriage 114 accommodates the light sources 103 and 104, the reflectors 105 and 106, and the mirror 107. A carriage 115 accommodates the mirrors 108 and 109.

The carriages 114 and 115 mechanically move in a sub scanning direction Y orthogonal to an electrical scanning direction (main scanning direction X) of a CCD image sensor (charge coupled device image sensor: hereinafter referred to as the CCD) 111 at velocities of V and V/2, respectively, to thereby scan the entire surface of the original.

A lens 110 focuses reflected light and transmitted light from the original on the CCD 111. The CCD 111 is mounted on a substrate 112 to convert the reflected light and the projected light to electric signals. A digital image processing section 113 performs image processing, described in detail hereinafter.

An external interface (I/F) section 116 provides interface with external devices. More specifically, the external I/F section 116 can be connected to a facsimile machine, not shown, a LAN I/F device, not shown, and the like. Transmission and reception of image information and code information to and from the facsimile machine and the LAN I/F device is controlled by mutual communication between the control section 100 (not shown) of each connection device and a CPU 301 (see FIG. 2).

FIG. 2 is a block diagram showing the configuration of the control section appearing in FIG. 1 and sections associated therewith.

As shown in FIG. 2, the control section 100 is comprised of the CPU 301, a memory 302, and an operating section 303, and is connected to the digital image processing section 113, the external I/F section 116, and a printer control section 250.

Figure 10:
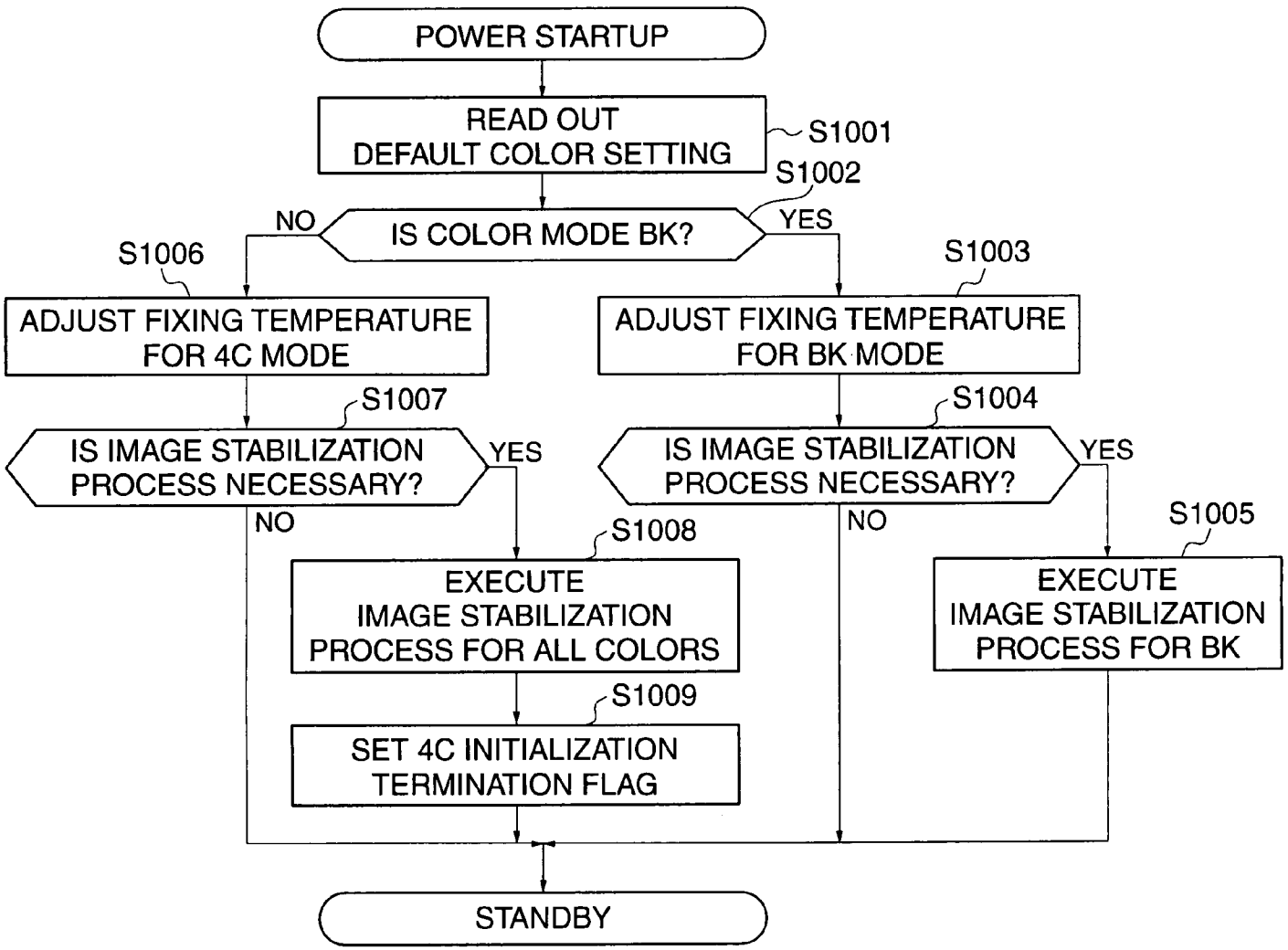
Figure 11:
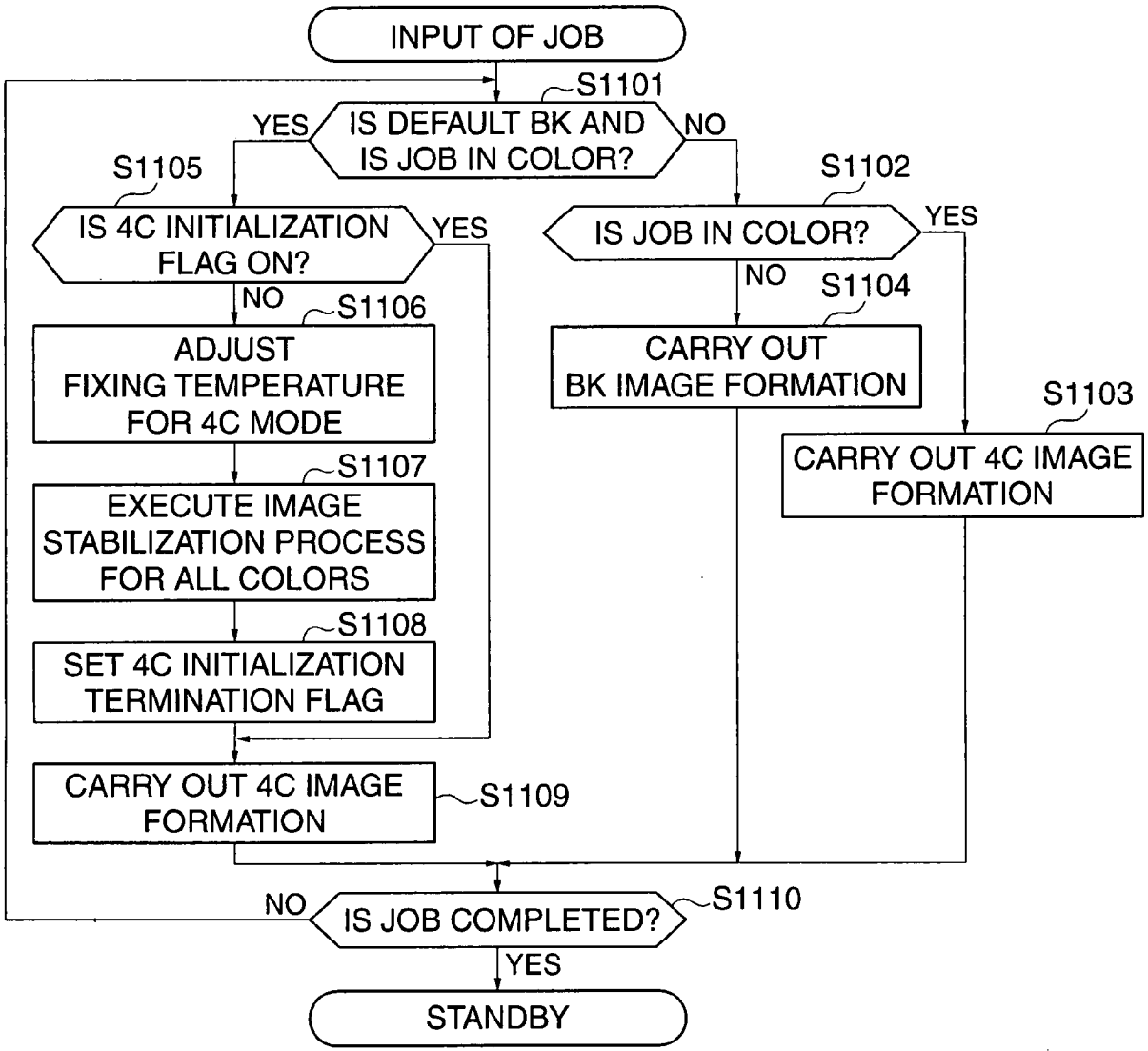
FIG. 11 is a flowchart of a process executed when a job is input in a standby state of the image forming apparatus in FIG. 1.

The CPU 301 is provided with I/Fs for transmitting and receiving information to and from the digital image processing section 113 and the printer control section 250, respectively, for control thereof, and executes processing shown in FIGS. 10 and 11, based on control programs. The memory 302 includes a storage section storing the control programs, a page memory section 514 (see FIG. 3) for storing image data information, and a backup RAM storing information (see FIG. 12) indicative of a list of color modes to be set and items of an image stabilization process to be executed in the respective color modes. The operating section 303 is comprised of a touch panel-equipped liquid crystal display screen for an operator to use in entering instructions for processing to be executed by the image forming apparatus and for giving notifications, such as information and warning regarding the processing, to the operator, and hard keys.

Figure 3:
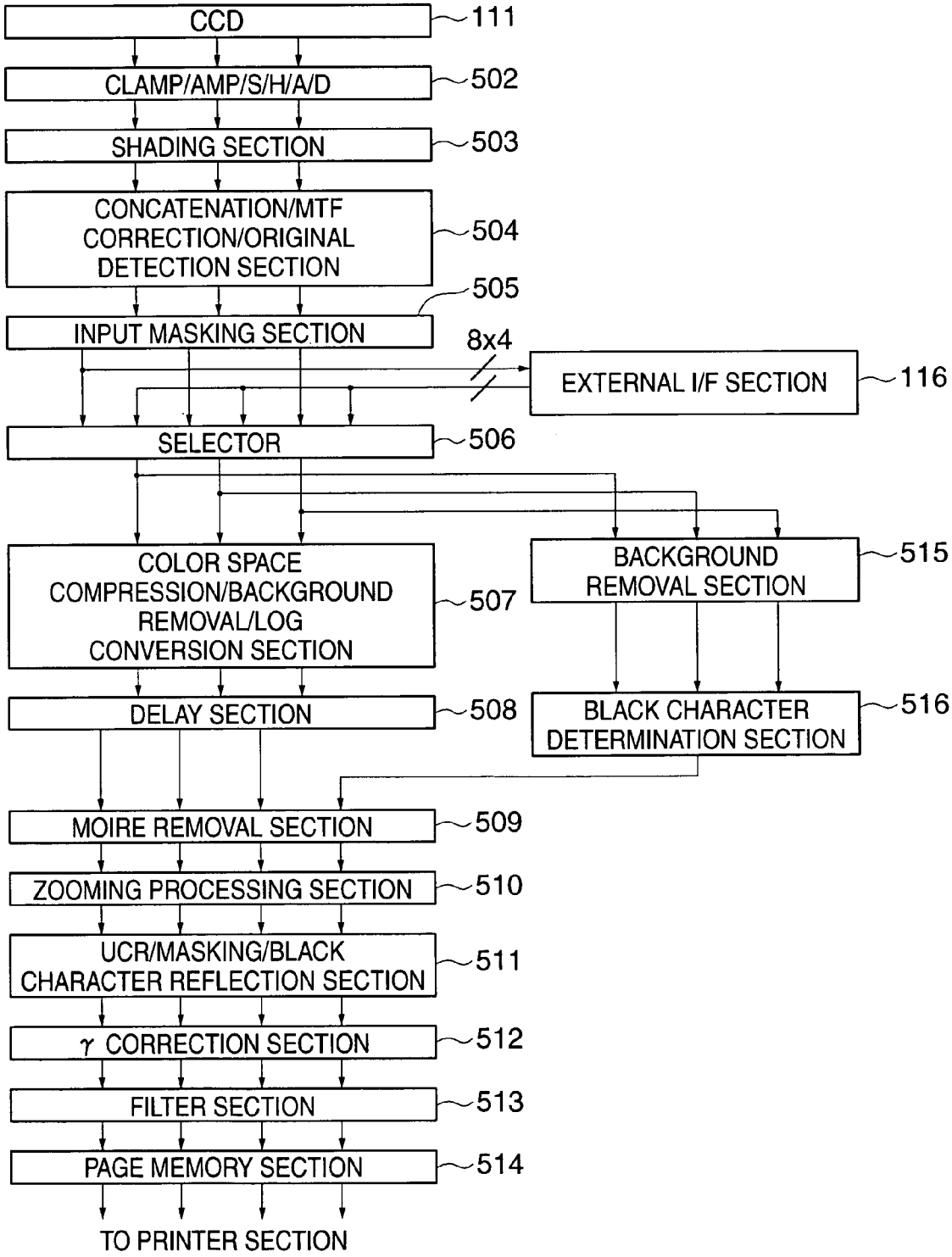
FIG. 3 is a block diagram showing flows of image signals in the image forming apparatus in FIG. 1.

FIG. 3 is a block diagram showing the flow of image signals in the image forming apparatus in FIG. 1.

As shown in FIG. 3, the digital image processing section 113 is comprised of a clamp/Amp (Amplifier)/S/H (Sample Hold)/A/D section 502 connected to the CCD 111, a shading section 503, a concatenation/MTF (Modulation Transfer Function) correction/original detection section 504, an input masking section 505, a selector 506 connected to the external I/F section 116, a color space compression/background removal/LOG conversion section 507, a delay section 508, a moire removal section 509, a zooming (magnification/reduction) processing section 510, a UCR/masking/black character reflection section 511, a γ correction section 512, a filter section 513 connected to the page memory section 514, a background removal section 515, and a black character determination section 516.

An original on the original platen glass 101 is irradiated with light from the light sources 103 and 104, and reflected light (and transmitted light) from the original is guided to the CCD 111 where it is converted into electric signals. If the CCD 111 is a color sensor, R, G, and B color filters may be mounted on one CCD line in an inline form in the order of R, G, and B, or R, G, and B filters may be arranged on three CCD lines side by side. Alternatively, on-chip filters may be used, or filters may be formed independently of the CCD.

The electric signals (analog image signals) are input to the digital image processing section 113. The clamp/Amp/S/H/A/D section 502 samples/holds (S/H) the signals, clamps the dark level of each analog image signal to a reference potential, amplifies the signal to a predetermined level, and A/D converts the signal into R, G, and B digital signals each consisting of eight bits. The processing order is not limited to that represented by the section name of the clamp/Amp/S/H/A/D section 502.

The digital signals are subjected to shading correction and black correction by the shading section 503, and then to the following processes by the concatenation/MTF correction/original detection section 504. More specifically, if the CCD 111 is a 3-line CCD, read positions on the respective lines differ from each other, and therefore, in concatenation processing, delay amounts of the respective lines are adjusted in accordance with the read speed to correct signal timing so as to make the read positions on the three lines coincide with each other. MTF in read operation changes depending on the read speed and magnification, and therefore, MTF correction is performed to correct such a change. Original detection is performed to recognize the size of an original by scanning the original on the original platen glass 101.

The input masking section 505 corrects the digital signals having undergone read position timing correction based on the spectral characteristics of the CCD 111 and the spectral characteristics of the light sources 103 and 104 and the reflectors 105 and 106. The outputs from the input masking section 505 are input to the selector 506 which can switch between the outputs and external I/F signals. Signals output from the selector 506 are input to the color space compression/background removal/LOG conversion section 507 and the background removal section 515.

Each signal input to the background removal section 515 is subjected to background removal and then input to the black character determination section 516 for determining whether or not the input signal corresponds to a black character on the original. The black character determination section 516 generates a black character signal from the input signal. The color space compression/background removal/LOG conversion section 507, to which the outputs from the selector 506 are input, carries out color space compression on the input signals and determines whether each read image signal falls within a range reproducible by the printer section 2. If the image signal falls within the range, no correction is performed, whereas if the signal falls outside the range, the image signal is corrected such that it falls within the range reproducible by the printer section 2. Then, background removal processing is executed, and LOG conversion processing is performed to convert the R, G, and B signals into C, M, and Y signals.

Thereafter, the delay section 508 adjusts the timings of the output signals from the color space compression/background removal/LOG conversion section 507 with respect to the timings of the black character signals generated by the black character determination section 516.

The moire removal section 509 removes moire components from these two types of signals output from the black character determination section 516 and the delay section 508, and the zooming processing section 510 subjects the signals to a zooming processing in the main scanning direction. The UCR/masking/black character reflection section 511 performs the following processing: In UCR processing, Y, M, C, and K signals are generated from the Y, M, and C signals processed by the zooming processing section 510; in masking processing, the signals are corrected into signals suited to output operation of the printer section 2; and in black character reflection processing, the determination signals (black character signals) generated by the black character determination section 516 are fed back to the Y, M, C, and K signals.

The signals processed by the UCR/masking/black character reflection section 511 are subjected to density adjustment by the γ correction section 512, and subjected to smoothing or edge processing by the filter section 513.

The pieces of image data information obtained by the above processes are temporarily stored in the page memory section 514 on the control section 100, and then sequentially delivered as image data signals to a printer control section 250 in timing synchronous with a video clock signal according to color-by-color image write reference timing signals output from the printer control section 250.

Next, referring again to FIG. 1, a description will be given of the arrangement of the digital color image printer section 2.

A laser scanner 201 forms a latent image on a photosensitive drum 202 as a photosensitive member. A multi-color developing device 203 is comprised of a developing mechanism and a development switching mechanism. A primary transfer roller 204 is first transfer means for transferring a toner image formed on the photosensitive drum 202 onto an intermediate transfer member 205. The laser scanner 201, the photosensitive drum 202, and the multi-color developing device 203 form image forming means. A secondary transfer roller 206 is second transfer means for transferring the toner image formed on the intermediate transfer member 205 onto a sheet.

Further, the image forming apparatus is provided with a pressure roller 207, cassettes 208, 209, 210, and 211, feed rollers 212, 213, 214, and 215, sheet separating roller pairs 216, 217, 218, and 219, a manual feed roller 220, a registration roller pair 221, vertical path conveying roller pairs 222, 223, 224, and 225, a cleaning blade 230, a blade 231, a waste toner box 232, a discharge roller pair 233 as a discharge port also functioning as a reversing port, a double-sided printing path 234, and a manual feed tray 240.

The printer control section 250 functions as a receiver for receiving control signals from the CPU 301 on the control section 100 controlling the overall operation of the image forming apparatus. The printer control section 250 controls the printing operation of the digital color image printer section 2 according to the control signals sent from the CPU 301 that give instructions for starting of printing, and so forth.

The laser scanner 201 irradiates the photosensitive drum 202 with a laser beam corresponding to an image data signal while scanning the laser beam by a polygon mirror in the main scanning direction. Clockwise rotation of the photosensitive drum 202 causes an electrostatic latent image formed on the surface of the photosensitive drum 202 to face a corresponding one, which is brought to a developing cylinder position, of respective developing rotary sections of four colors (yellow (Y), magenta (M), cyan (C), and black (BK)) constituting the multi-color developing device 203. Developer (toner) is blown from the multi-color developing device 203 onto the surface of the photosensitive drum 202, in an amount corresponding to a potential difference created between the surface of the photosensitive drum 202 with the electrostatic latent image formed thereon and the developing cylinder surface to which a developing bias is applied by a high-voltage power supply, whereby the electrostatic latent image is developed on the surface of the photosensitive drum 202.

The toner image thus formed on the photosensitive drum 202 is transferred onto the intermediate transfer member 205 being rotated counterclockwise by the photosensitive drum 202 (primary transfer) rotating clockwise. In a black monochrome image forming mode, images are sequentially formed on the intermediate transfer member 205 at predetermined time intervals (primary transfer). On the other hand, in a full color image forming mode, electrostatic latent images corresponding to respective ones of the four colors are sequentially developed on the surface of the photosensitive drum 202 by bringing each corresponding developing rotary section into the developing cylinder position opposed to the photosensitive drum 202, and primarily transferred onto the intermediate transfer member 205, on a color-by-color basis. The primary transfer of the full color image is thus completed when the intermediate transfer member 205 performs four rotations, i.e. when the four color images are primarily transferred.

A patch sensor 241, which is a non-contact sensor, reads a test pattern (halftone patches) for measuring developing toner densities of an image developed on the photosensitive drum 202 to thereby detect color-specific developing toner densities (developing toner density detection), and outputs detection signals for feedback control of toner supply amounts. A toner density sensor 242, which is also a non-contact sensor, irradiates a toner on the developing cylinder with light and detects reflected light (near infrared light) from the toner by a photodiode, to thereby sense the density of the toner within the multi-color developing device 203 (toner density detection).

The patch sensor 241 detects the densities of developed halftone patches, while the toner density sensor 242 directly detects the densities of the toners within the multi-color developing device 203. More specifically, the result of the toner density detection by the toner density sensor 242 is fed back to the result of the halftone patch density detection (developing toner density detection) by the patch sensor 241, whereby a target density level is corrected.

In the developing toner density detection, halftone patch densities corresponding to the respective colors including the black (BK) color are detected, but in the tone density detection, the toner density of the BK color is not detected because the density level of the BK toner used in a first mode in the present invention cannot be detected due to the toner characteristic thereof. More specifically, while the other toners than the BK toner reflect near infrared light, the BK toner and a carrier thereof absorb near infrared light. Therefore, as the amount of a toner other than the BK toner in the developer decreases, the amount of near infrared light reflected therefrom also decreases, and on the other hand, with an increase in the amount of the toner other than the BK toner, the amount of near infrared light reflected therefrom increases. By utilizing this phenomenon, the actual toner density can be calculated based on the amount of the reflected light.

To perform the toner density detection, it is necessary to rotate the developing rotaries of the multi-color developing device 203 to bring the developing cylinder into a position opposed to the toner density sensor 242, on a color-by-color basis.

In an automatic sheet feed mode, sheets set in the cassettes (an upper cassette 208, the lower cassette 209, the third cassette 210, the fourth cassette 211) are sequentially fed by the associated feed rollers 212, 213, 214, and 215, and then conveyed by the associated sheet separating roller pairs 216, 217, 218, and 219 to the associated vertical path conveying roller pairs 222, 223, 224, and 225, followed by being conveyed to the registration roller pair 221 by the vertical path conveying roller pairs 222, 223, 224, and 225.

In a manual sheet feed mode, a sheet placed on the manual feed tray 240 is conveyed by the manual feed roller 220 to the registration roller pair 221, and then sent between the intermediate transfer member 205 and the secondary transfer roller 206 in timing in which transfer of the sheet to the intermediate transfer member 205 is completed.

Thereafter, each sheet fed automatically or manually is conveyed toward a fixing device (a fixing roller and the pressure roller 207) in a state sandwiched between the secondary transfer roller 206 and the intermediate transfer member 205, and pressed against the intermediate transfer member 205, whereby the toner image transferred to the intermediate transfer member 205 is secondarily transferred onto the sheet. The toner image transferred onto the sheet is fixed on the sheet by being heated and pressed by the fixing roller and the pressure roller 207.

Residual toner remaining on the intermediate transfer member 205 without being transferred onto the sheet is cleaned by post-processing control in the second half of an image forming sequence, more specifically, it is scraped off the surface of the intermediate transfer member 205 by bringing the cleaning blade 230, which can be brought into and out of contact with the surface of the intermediate transfer member 205, into sliding contact therewith.

In a photosensitive drum unit, residual toner is scraped off the surface of the photosensitive drum 202 by the blade 231, and conveyed to the waste toner box 232 formed integrally with the photosensitive drum unit. Further, a secondary transfer positive bias and a secondary transfer reverse bias are alternately applied to the intermediate transfer member 205 from a high-voltage power supply to cause positive and negative residual toners possibly absorbed on the surface of the secondary transfer roller 206 to be absorbed onto the intermediate transfer member 205, and the residual toners absorbed onto the intermediate transfer member 205 are scraped off by the cleaning blade 230. Thus, all residual toners are completely cleaned to terminate the post-processing control.

The sheet having the image fixed thereon by the fixing roller and the pressure roller 207 is discharged via the discharge roller pair 233.

In a double-sided image forming mode in which images are formed on both or opposite sides of a sheet, to perform inverting processing outside the apparatus, the sheet with the image fixed thereon is discharged into the discharge port via the discharge roller pair 233 and temporarily stopped thereat such that its trailing end remains inside the apparatus by an amount corresponding to a predetermined distance. More specifically, an inverting start instruction is awaited in a state in which the trailing end of the sheet remains in an inverting standby position the predetermined distance inward from the discharge roller pair 233 so that the sheet can be inverted and guided into the double-sided printing path 234. When the inverting start instruction is issued, the sheet on standby in the inverting standby position is drawn in by the discharge roller pair 233 for inversion and conveyed along the double-sided printing path 234 from the inverting standby position into a double-sided printing standby position.

The sheet conveyed along the double-sided printing path 234 is detected by a double-sided printing sensor and then further conveyed by an amount corresponding to a predetermined distance to be temporarily held in the double-sided printing standby position. Then, when preparation for image formation on a second side surface of the sheet is completed and a re-feed instruction is issued, the sheet on standby in re-feed position is conveyed again to the registration roller pair 221 for image formation, whereafter an image is formed on the second side surface of the sheet.

In a full color image formation mode in which an image is formed on a sheet in full color, images for two sheets are formed on the intermediate transfer member 205 insofar as the sheet size permits. In the present embodiment, for sheets having a length equal to or smaller than the LTR size (216 mm) in the sub scanning direction, images for two sheets are formed on the intermediate transfer member 205 such that they simultaneously exist on the intermediate transfer member 205 side by side.

In a single-sided image formation mode in which an image is formed on one side of a sheet, images formed on the intermediate transfer member 205 are transferred onto two respective sheets fed from the same cassette 208, 209, 210 or 211. On the other hand, in the double-sided image formation mode in which images are formed on opposite sides of a sheet, images formed on the intermediate transfer member 205 are transferred onto one side of a sheet already having an image formed on the other side thereof and having been on standby in the double-sided printing standby position on the double-sided printing path 234 and one side of a sheet fed from a cassette 208, 209, 210, or 211, respectively.

In this double-sided image formation mode, a remaining one of two images (data) one of which has already been formed on one side of a sheet, for the other side of the sheet (which is inverted and re-fed), and one of two images (data) neither of which has been formed on a sheet (newly fed from a cassette) are formed on the two sheets, alternately. In image formation on a sheet larger than the LTR size, it is impossible to form images for two sheets on the intermediate transfer member 205 such that they simultaneously exist on the intermediate transfer member 205 side by side, and therefore only an image for one sheet is formed.

FIGS. 4 to 9 are views showing examples of screens displayed on the operating section 303 in FIG. 2.

Figure 4:
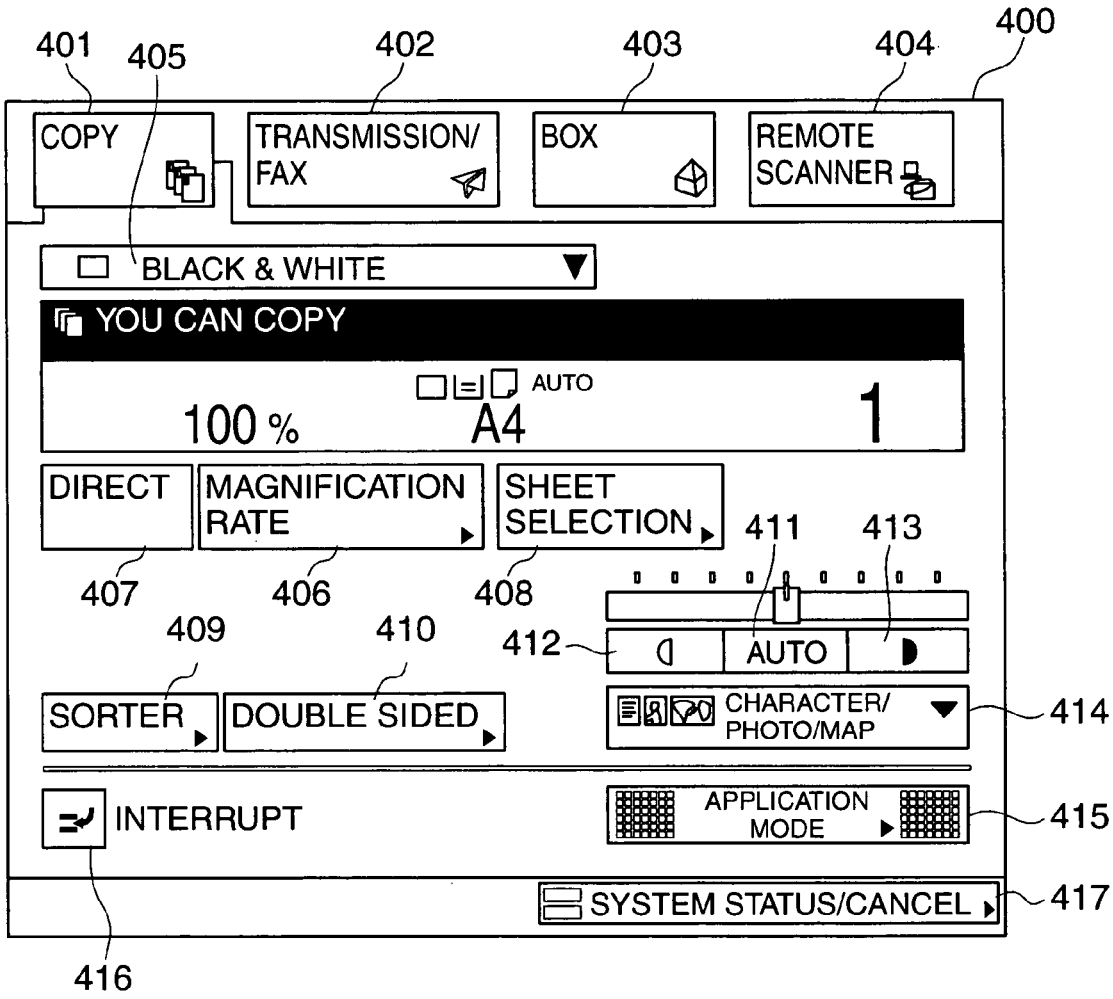
FIG. 4 is a view of an example of a screen displayed on an operating section appearing in FIG. 2.

The operating section 303 is comprised of the liquid crystal display screen 400 shown in FIG. 4 and the hard keys (including ten keys for entering numerical values, user mode keys for displaying user customizing items, and a copy key for giving a copying start instruction), not shown.

Referring to FIG. 4, the liquid crystal display screen 400 is a screen with a touch panel, which is capable of displaying the status of the image forming apparatus, a desired number of copies, magnification, and sheet size. To carry out mode setting in a more detailed manner, contents displayed on the liquid crystal display screen 400 can be switched to desired ones according to a mode to be set by depressing respective corresponding keys on the touch panel on the liquid crystal display screen 400. Thus, the modes provided for the image forming apparatus can be selectively set from the displayed contents. In a standby mode, a standard screen including keys described hereinbelow is normally displayed on the liquid crystal display screen 400.

A copy screen switch key 401 is depressed to switch the liquid crystal display screen 400 to a copying setup screen for setting a copy mode. A facsimile transmission setup screen switch key 402 is depressed to switch the liquid crystal display screen 400 to a facsimile transmission setup screen for setting a facsimile transmission mode. A box screen switch key 403 is depressed to switch the liquid crystal display screen 400 to a setup screen for scanning an original on the original platen glass to store data in a box (hard disk), or printing out or transmitting data in the box. A remote scanner setup screen switch key 404 is depressed to switch the liquid crystal display screen 400 to a setup and cancel screen for use in remotely scanning an original on the original platen glass 101.

Figure 5:
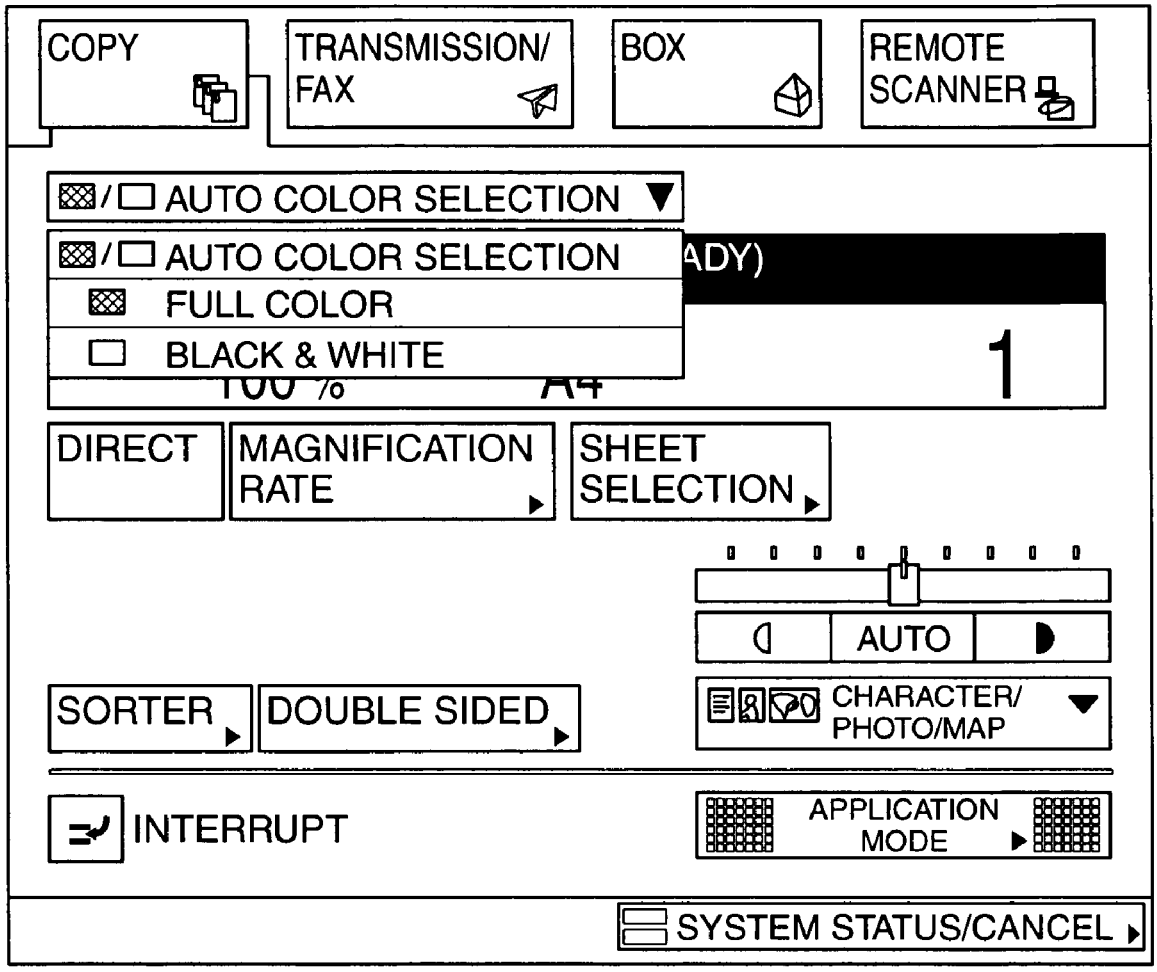
FIG. 5 is a view of an example of a child screen for selecting a color mode, which is displayed when a color selection key is depressed on the operating section.
Figure 6:
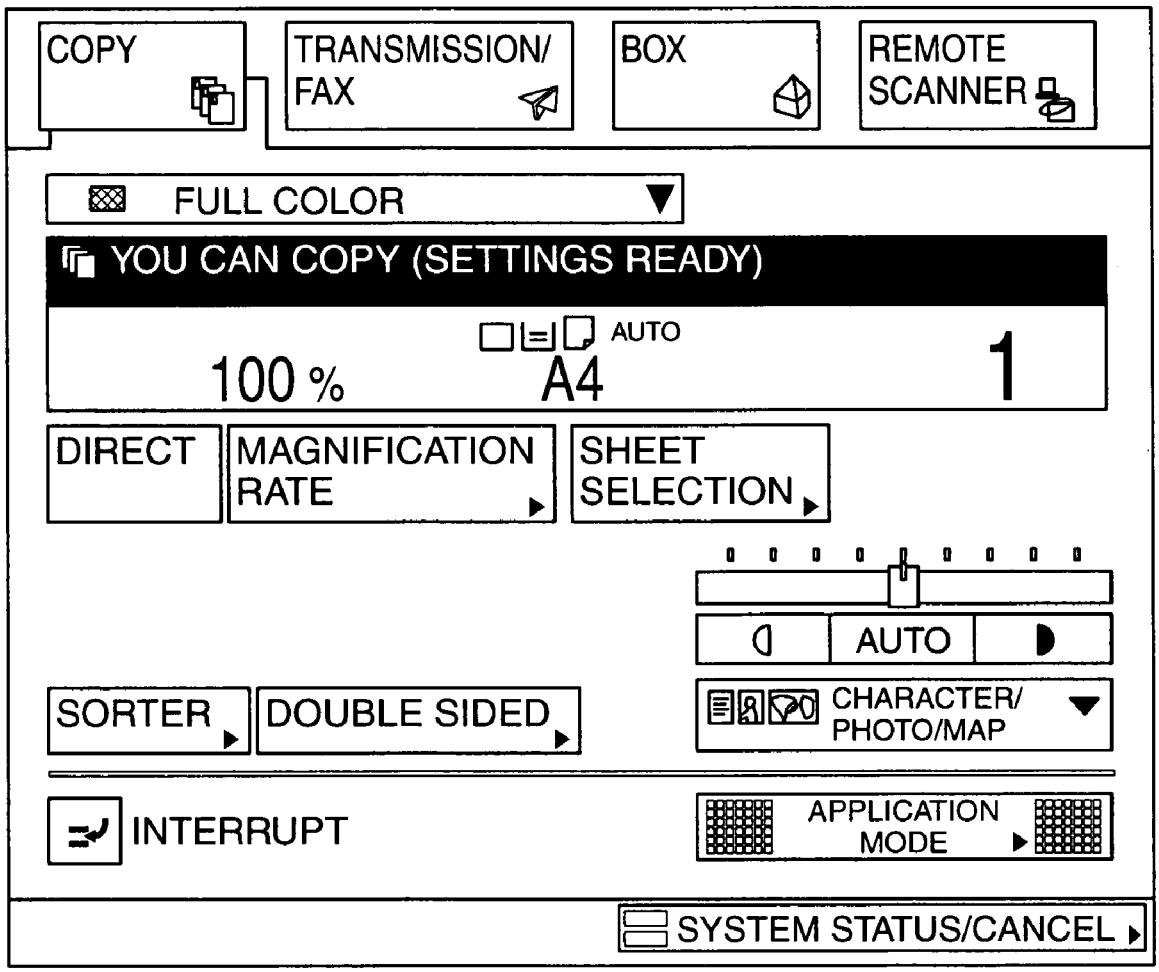
FIG. 6 is a view of an example of a screen displayed on the operating section when the color mode is set to a full color mode.
Figure 7:
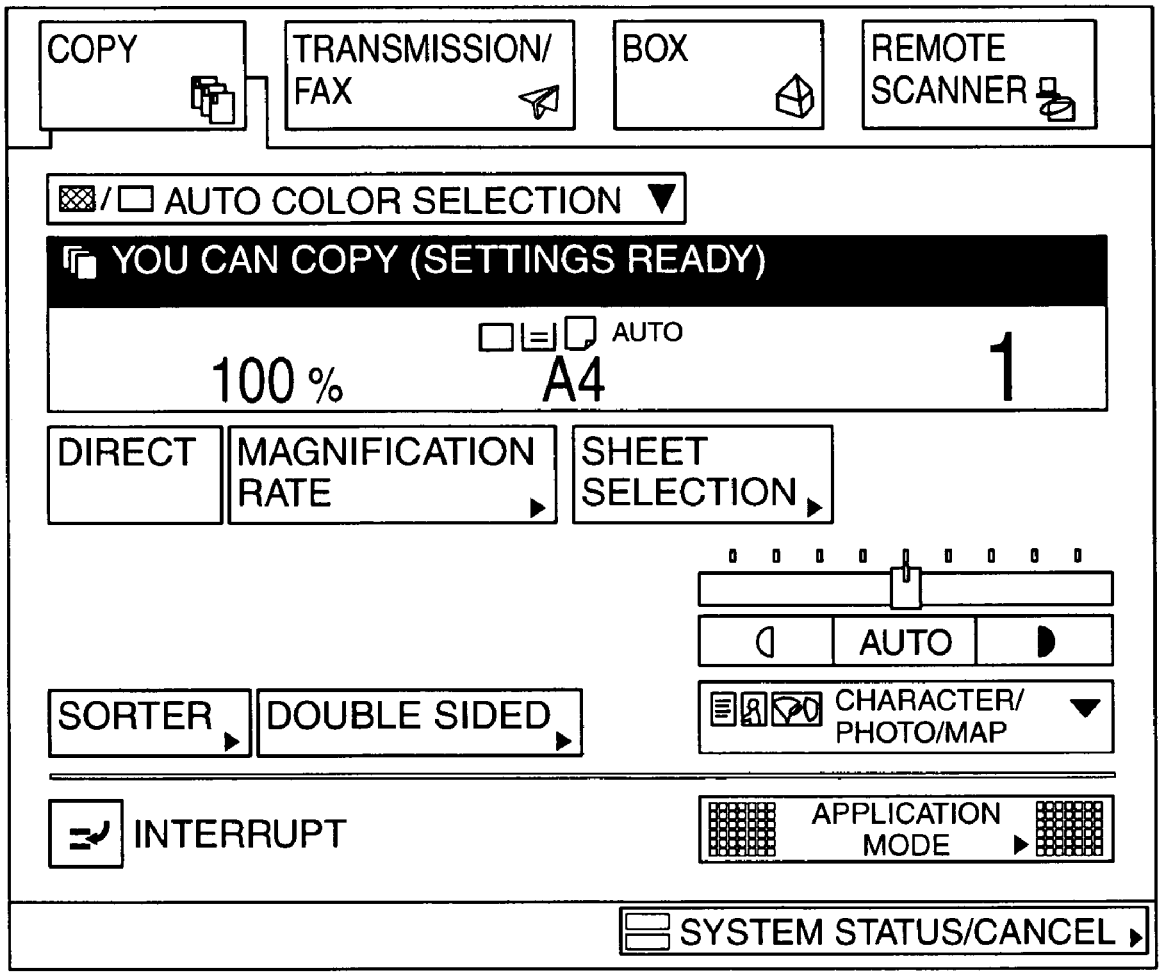
FIG. 7 is a view of an example of a screen displayed on the operating section when the color mode is set to an automatic color mode.
Figure 8:
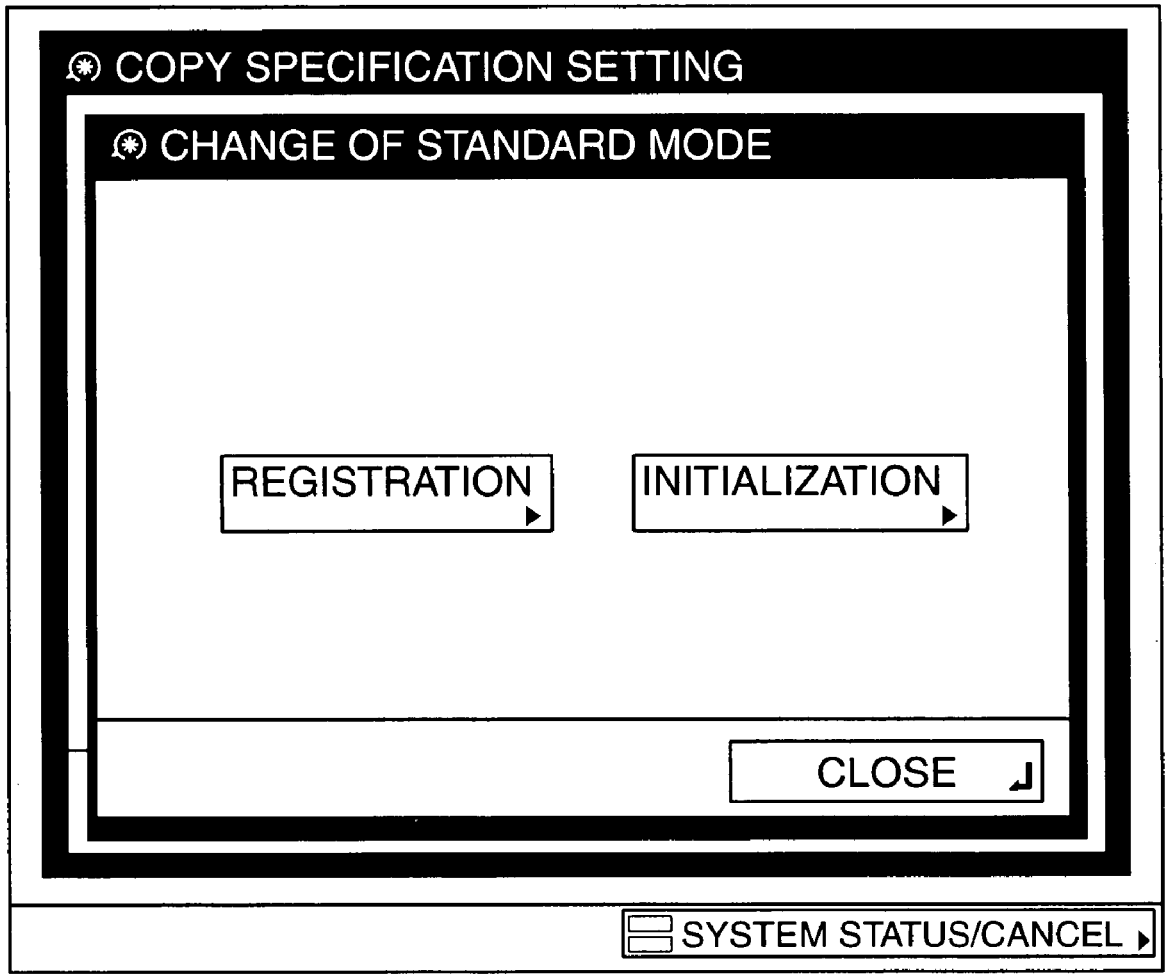
FIG. 8 is a view of an example of a standard mode setup screen displayed on the operating section.

A color selection key 405 is depressed to select a color mode. When the color selection key 405 is depressed, a child screen for selecting a color mode is opened (a state shown in FIG. 5). As shown in FIG. 5, on the child screen are displayed an automatic color selection (ACS) key selected for output after automatically determining whether the type of an original (i.e. the color of an image on the original) for output is a color original or a BK monochrome original (black and white original), a full color key selected for output in a full color mode, and a black and white key selected for output in a BK monochrome mode (white and black mode), so that a color mode can be set by depressing one of the keys. A zoom selection key 406 is depressed to select a reduction ratio or an enlargement ratio between regular sizes of sheets, automatic zooming, a zoom magnification ratio or the like. A direct key 407 is depressed to return an enlargement or reduction magnification ratio to equimagnification (=100% magnification). A sheet selection key 408 is depressed to select a type of sheets on which images are to be copied.

A sorter key 409 is depressed to select a "sort" mode for bundling printed sheets on a copy-by-copy basis, a "group sort" mode for bundling printed sheets on a page-by-page basis, or a "staple sort" mode for bundling and stapling printed sheets on a copy-by-copy basis.

A double-sided key 410 is depressed to select a "single-double" setting for printing images formed on respective one sides of two single-sided originals on opposite sides of a sheet, respectively, a "double-double" setting for printing images formed respectively on opposite sides of one double-sided original on opposite sides of a sheet, respectively, a "double-single" setting for printing images formed respectively on opposite sides of one double-sided original on one side of each of two sheets, and a "duplex-to-duplex double" setting for printing halves of an image formed on one single-sided original on opposite sides of a sheet, respectively.

An automatic density setting key 411 is depressed to automatically adjust the density of an original, e.g. to copy newspaper or the like after removing its background. Referring to manual density setting keys 412 and 413, the key 412 is depressed to reduce output density, and the key 413 is depressed to increase output density.

An image processing selection key 414 is depressed to select image processing parameters according to an original type, e.g. for a "letter mode" to be selected when only letters form the contents of an original, a "print photographing mode" to be selected when only photograph(s) form(s) the contents of an original, or a "letter/photograph/map mode" to be selected when a mixture of letters and photograph(s) form the contents of an original. An application mode selection key 415 is depressed to select a mode, such as a "frame erase" mode, a "binding margin" mode, or a "reduction layout" mode.

An interrupt key 416 is depressed when a user desires to make a copy by interrupting execution of continuous copying/printing output. A system confirmation key 417 is depressed to confirm or check the status of a job, such as copying, reception, faxing, printing, or transmission, or the history of such a job, the status of each device (a scanner, a printer, a facsimile), the status of network transmission/reception, the status of a sheet feed stage, or the status of a consumable article, such as a toner.

FIG. 4 shows a state of the apparatus where the "black and white" mode is selected by the color selection key 405, and FIG. 5 shows a state of the apparatus where the "automatic full color" mode is selected. Further, each of the above described modes including the color selection can be registered as a default setting in a standard screen.

For example, when it is desired to register the modes set in FIG. 4, including the color selection (in FIG. 4, the color mode is set to the BK monochrome mode), as default settings in the standard screen, first, a user depresses the user mode key (hard key, not shown) on the operating section 303 to cause the apparatus to display a screen for selection of items for user's own setting. The optional items include a "standard mode change" shown in FIG. 8, so that a "registration" key is selected and depressed on the screen to display a screen 400 for confirmation of registration of the modes currently set on the liquid crystal display screen (see FIG. 9).

Figure 9:
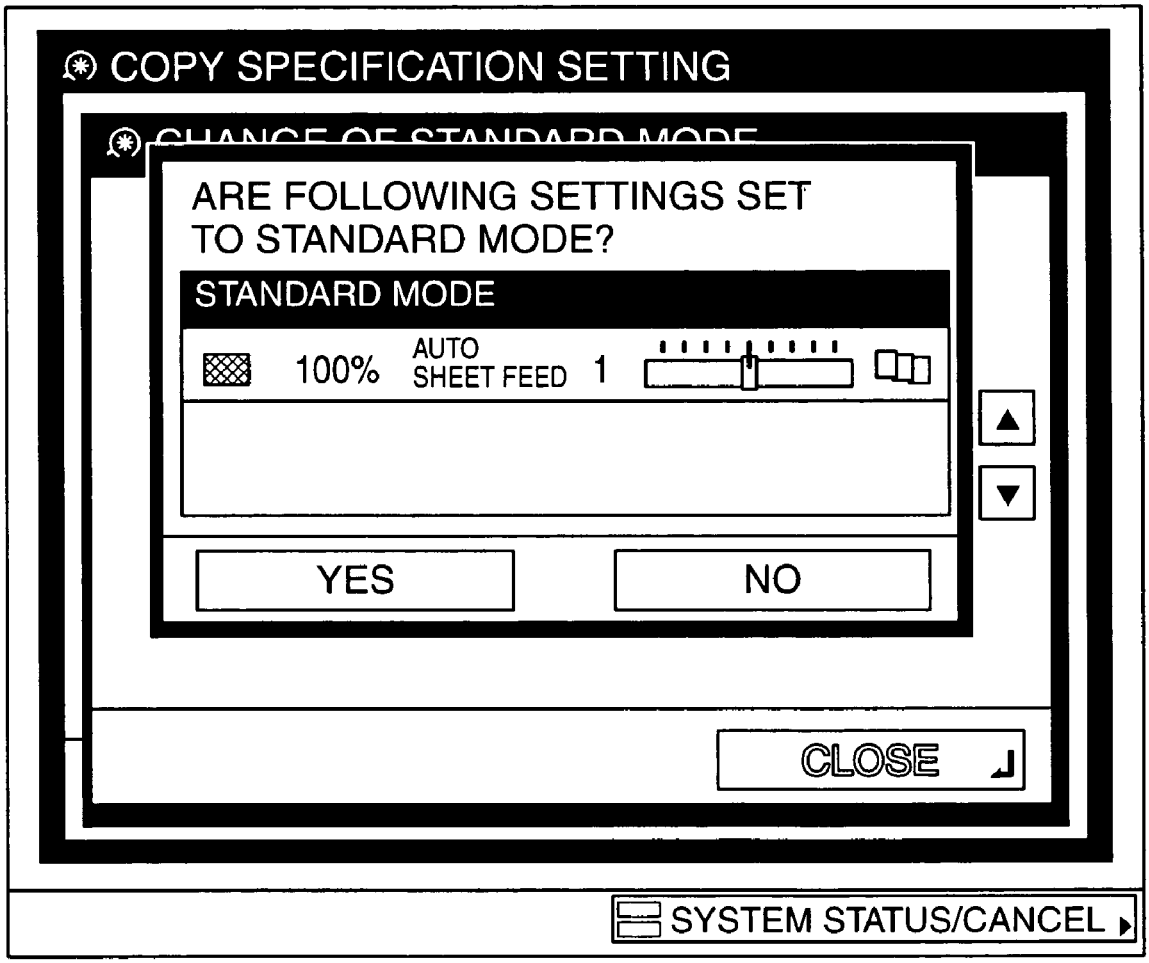
FIG. 9 is a view of an example of a standard mode setting details confirmation screen displayed on the operating section.

The screen in FIG. 9 displays a list of modes registerable in the standard screen. In the illustrated example, "BK monochrome", "equimagnification", "automatic sheet feed", "number: 1", are set, and when a "YES" key is depressed on the screen, the set modes including the color selection are registered in the standard screen. As a result, these set values are stored in a backup RAM, not shown, and when the power is turned on, they are read out from the backup RAM to be displayed on the standard screen.

Next, a description will be given of the image stabilization process executed by the image forming apparatus of the present embodiment when the power is turned on. The image stabilization process provides image density control for stabilization of color-dependent image quality, automatic toner replenishment control (hereinafter referred to "ATR"), and automatic transfer voltage control (hereinafter referred to "ATVC"). These controls are basically provided for the purpose of correcting image processing parameters to thereby stabilize image quality.

The image density control is intended to keep constant the maximum density (hereinafter referred to as "Dmax") of each color toner (toner maximum density correcting process) and to keep linear the halftone gradation characteristics (hereinafter referred to as "Dhalf") of input image signals (gradation correcting process). The ATR is intended to keep time-varying toner densities (ratios between toners and carriers) in the multi-color developing device 203 constant (target toner density value-correcting process). The ATVC is intended to set optimal transfer high voltage for toner transfer (transfer high-voltage setting process).

In the image density control, contrast potential Vcont as the difference between developing bias potential and highlight potential is controlled based on a test pattern (halftone patches) on the photosensitive drum 202 read by the patch sensor 241 disposed at the location opposed to the photosensitive drum 202, to thereby stabilize the maximum density Dmax, and at the same time a lookup table (hereinafter referred to as the "LUT") as output tone correcting means is corrected to stabilize gradation linearity. In full color image formation using the four colors, even slightest deviation in density or gradation linearity of even one color can throw the colors out of balance, and therefore, basically, image density control processes should be simultaneously executed on the four colors for stabilization of image quality.

Similarly, in the ATR as well, the densities of a test pattern (halftone patches) on the photosensitive drum 202 are read by the patch sensor 241. Then, the read values and associated target density values are compared with each other, and control is provided to increase or reduce the toner replenishment amounts based on the result of the comparison such that the toner replenishment amounts become equal to the associated target density values.

In an image forming unit comprised of the photosensitive drum 202 and the multi-color developing device 203, toner consumption causes changes in toner components and toner particle distribution, and long use of the unit causes wear and degradation of the photosensitive drum 202 and component parts contributing to development. Further, the resistance and charge characteristics of toners and component parts change due to temperature and humidity and aging. This makes it difficult to maintain constant image quality under the same processing conditions. Therefore, the image density control described above is executed during execution of a job whenever a predetermined number of sheets are printed or at predetermined time intervals, or when an environmental change larger than a predetermined value is detected, whereby color images of constant quality can be obtained.

The image density detection is carried out by measuring the amount of light reflected from the test pattern (halftone patches) on the photosensitive drum 202, by the patch sensor 241 as an optical sensor having a light emitting part and a light receiving part. Image density is kept constant by changing processing parameters, such as developing bias, such that the reflected light amount is kept constant.

For halftone patches for image density detection, it is naturally preferable to use a solid patch for measurement of solid patch density so as to control solid density. In general, however, a region saturated with respect to the development characteristics is often used for measurement of the solid density, so that solid density changes little even if the bias condition is changed. This often hinders density control executed based on the solid patch density measurement from coping with deformation, blur, or the like of a high-density area. Therefore, in the present embodiment, the Dmax control is executed by controlling the density of a halftone patch in the vicinity of an image density of 1.0 to a constant level.

The Dmax control is advantageous not only in maintaining a constant balance between the individual colors, but also in preventing dispersion of a color-superimposed character due to piling up of too much toner or fixing failure. In the present embodiment, the developing bias potential is set as a parameter to be feedback controlled when image density detection is executed, and feedback control of the high-voltage power supply for applying developing bias voltage is executed such that the density of a halftone patch corresponds to an image density of 1.0.

In the halftone gradation control in the present embodiment, whenever image processing is performed, nine halftone patches different in image ratio (8-bit gradation signals are used in the present embodiment, and therefore data values of 0x00, 0x10, 0x20, 0x40, 0x60, 0x80, 0xC0, 0xE0, and 0xFF are used for the nine halftone patches, respectively) for each of three kinds: one kind for dithering, and two kinds for screening, are sequentially formed on the photosensitive drum 202. An inverse function of input/output characteristics between image densities and data obtained by the patch sensor 241 reading halftone patches is determined, and in actual image formation, image data is multiplied by this inverse function and then output, whereby finally, linear input/output characteristics, i.e. appropriate halftone gradation characteristics can be obtained.

In the gradation control of halftones, to prevent a non-linear input/output characteristic ($\gamma$ characteristic) peculiar to electrophotography from causing deviation of the output density with respect to an input image signal to hinder formation of a natural-looking image, it is a general practice to carry out image processing such that the $\gamma$ characteristic is canceled out, so as to keep the input/output characteristic linear.

In the ATR in the present embodiment, the toner replenishment amount calculated from video count data as the count value of a video signal output from the external I/F section 116 is corrected in predetermined timing. In this correction, the density of halftone patches formed on the photosensitive drum 202 by the difference in potential between a primary charge bias and the developing bias is detected by the patch sensor 241, and compared with the target density value, so as to increase or decrease the toner replenishment amount based on the result of the comparison.

In this case, since the toner replenishment amount is corrected based on the density of halftone patches, there is a fear that the toner density might not be maintained at an appropriate value, which causes dispersion of toners in the image forming apparatus and attachment of carrier to the photosensitive drum 202. To eliminate this, the target density value is corrected in predetermined timing to thereby hold the toner density in the multi-color developing device 203 at the appropriate value. If it is necessary to execute a density stabilization process when the power of the image forming apparatus is turned on, a halftone patch image is formed, and the target density value is feedback controlled based on the detected halftone patch density data.

The ATVC includes primary ATVC for determining an optimal primary transfer high voltage for transfer of toner from the photosensitive drum 202 to the intermediate transfer member 205, and secondary ATVC for determining an optimal secondary transfer high voltage for transfer of toner from the intermediate transfer member 205 to a sheet. The secondary ATVC is started when the number of sheets for image formation has reached a predetermined number in pre-image formation rotation of the photosensitive drum 202 executed after receiving an image formation start instruction. The primary ATVC is executed when the power is turned on, and image formation sequence of each color toner is executed. In the primary ATVC, a predetermined voltage is applied to the primary transfer roller 204 from the high-voltage power supply, and an electric current flowing at this time is measured, to generate a primary transfer contrast voltage-current table.

First, a description will be given of a color mode-by-color mode image stabilization process (power supply startup sequence) executed when the power of the image forming apparatus is turned on, with reference to FIG. 10.

FIG. 10 is a flowchart of the color mode-by-color mode image stabilization process executed when the power of the image forming apparatus in FIG. 1 is turned on. The process shown in the present flowchart is carried out based on a control program by the CPU 301 of the control section 100. In FIG. 10, 4-color full color is abbreviated as 4C.

After the power of the image forming apparatus is turned on, temperature adjustment control for the fixing device (the fixing roller and the pressure roller 207) is started. A monitoring task for monitoring the fixing temperature is started by a thermistor starting detection of the surface temperature of the fixing roller. When the thermistor detects that the surface temperature has reached a predetermined temperature, an initialization process is started to prepare for image formation. The initialization process includes not only the image stabilization process, described in detail hereinafter, but also a jam detection process and a process for positioning or alignment of component units of the apparatus.

Referring to FIG. 10, before starting the process to be executed when the power of the image forming apparatus is turned on, first in a step S1001, the CPU 301 reads out a color mode set by default from the backup RAM, and determines in a step S1002 whether or not the set color mode is the BK monochrome mode. If it is determined in the step S1002 that the BK monochrome mode is set (the color mode setting in FIG. 4), the present process proceeds to a step S1003, wherein the CPU 301 sets the fixing temperature for a BK monochrome image to a target temperature.

Then, the CPU 301 determines in a step S1004 whether or not the image stabilization process needs to be executed. In this step, whether or not the surface temperature of the fixing roller was e.g. below 50° C. when the power was turned on, whether or not an environmental change after execution of developing gradation density correction control in the immediately preceding loop has exceeded a predetermined level, and whether or not the cumulative number of output sheets printed with BK images has reached a predetermined number (e.g. 1000 sheets in the present embodiment) are all determined, and if the answer to any of the questions is affirmative (YES), it is determined that the image stabilization process needs to be executed.

If it is determined in the step S1004 that the image stabilization process needs to be executed, the process proceeds to a step S1005. In the step S1005, the CPU 301 selects only a BK-specific image density control process from information (see FIG. 12) indicative of a list of color mode-specific sets of image stabilization processes, which is stored in the memory 302, and executes the selected process. No other image density control processes than the BK-specific image density control process are executed in the step S1005. In the present image density control process, out of all the image density control processes for correction of Dmax and Dhalf of the four colors and correction of patch image densities used in the ATR to respective target density values, only BK-related correction processes are executed. When the BK monochrome mode is set, the toner density detection is not performed.

In the step S1005, the CPU 301 additionally executes a BK monochrome image-forming sequence during execution of the primary ATVC to apply the predetermined voltage to the primary transfer roller 204 from the high-voltage power supply, and measure an electric current flowing at this time, to generate the primary transfer contrast voltage-current table (only for the BK monochrome mode).

If it is determined in the step S1004 that the image stabilization process need not be executed, or when the image stabilization process is terminated in the step S1005, the temperature adjustment control for the fixing device is continued. When the fixing temperature reaches a target temperature for BK monochrome images, image formation is enabled, and the image forming apparatus enters a standby state.

If it is determined in the step S1002 that the set color mode is a mode other than the BK monochrome mode (the full color mode (color mode set in FIG. 6) or an automatic color selection (ACS) mode (color mode set in FIG. 7)), the process proceeds to a step S1006, and the CPU 301 sets the target temperature to a fixing temperature for color images.

Then, the CPU 301 determines in a step S1007 whether or not the image stabilization process needs to be executed. Similarly to the above, in this step, whether or not the surface temperature of the fixing roller was e.g. below 50° C. when the power was turned on, whether or not the environmental change after execution of the developing gradation density correction control on the immediately preceding occasion has exceeded a predetermined level, and whether or not the cumulative number of output sheets printed in full color has reached a predetermined number (e.g. 200 sheets in the present embodiment) are all determined, and if the answer to any of the questions is affirmative (YES), it is determined that the image stabilization process needs to be executed.

If it is determined in the step S1007 that the image stabilization process needs to be executed, the process proceeds to a step S1008, and the CPU 301 executes the image density control processes for all the colors, including the BK color, (yellow (Y), magenta (M), cyan (C), black (BK)). The image density control processes include the Dmax and Dhalf corrections as the image density control, and the target density value correction based on the results of detection of the densities of patches for use in the ATR and the toner density detection which is not performed in the BK monochrome mode.

In the step S1008, the CPU 301 additionally adjusts the primary ATVC. In the color mode and in the primary ATVC in the ACS mode, first, the BK monochrome image-forming sequence is executed to apply the predetermined voltage to the primary transfer roller 204 from the power supply, and measure an electric current flowing at this time, to generate the primary transfer contrast voltage-current table (for the BK monochrome mode). Then, the full color image-forming sequence is executed to apply a predetermined voltage to the primary transfer roller 204 from the power supply, and measure an electric current flowing at this time, to generate a primary transfer contrast voltage-current table (for the full color mode).

The BK monochrome table for the BK monochrome mode and the BK table for the color mode are basically different in values. This is because the resistance value of the contact point between the secondary transfer roller 206 and the intermediate transfer member 205 in the full color mode differs from that in the BK monochrome mode due to the influence of the amount of superposed toners piled up for full color image formation. Therefore, the BK monochrome image-forming sequence and the full color image-forming sequence are both executed to generate the two kinds of tables.

Then, in a step S1009, the CPU 301 sets a full color (4C) initialization termination flag indicating that the full color image stabilization process has been executed. When only the BK image stabilization process is executed after the power is turned on in the BK monochrome mode, and then a job is input after the default set value is changed to the full color mode, the CPU 301 determines, in processing performed after the start of the job, with reference to the 4C initialization termination flag, that the image stabilization process has not been executed, and uses the result of the determination for determining whether to execute the full color image stabilization process.

If it is determined in the step S1007 that the image stabilization process need not be executed, the CPU 301 continues the temperature adjustment control for the fixing device. Then, when the fixing temperature reaches the target temperature for full color images, image formation is enabled, and the image forming apparatus enters the standby state.

In the above described power startup sequence, if the BK monochrome is set by default, the Dmax and Dhalf corrections, the patch image density measurement, and the primary ATVC processing, as items of the image stabilization process, need not be executed for all the four colors, but the minimum image stabilization process only for the BK color suffices, which makes it possible to reduce the amount of processing for parameter correction to one fourth. Further, the toner density detection processing, which needs to be executed for the three colors other than the BK color in the full color mode, can be omitted in the BK monochrome mode, so that time required for the toner density detection processing can be reduced to zero.

Electric power consumed for the temperature adjustment control of the fixing device is generally large, and particularly after turn-on of the power, a large amount of heat is needed to raise the temperature of the cooled fixing device to a temperature that enables image formation. Therefore, in view of the limited maximum power consumption, exclusive control is performed which inhibits simultaneous execution of the other processing until the temperature of the fixing device reaches a predetermined temperature to thereby secure electric power required to raise the temperature of the fixing device. When the fixing device is warmed up to some extent, timing for starting the initialization process is determined, in view of time required for the initialization process including the image stabilization process, such that all the processing can be carried out within the entire wait time.

The fixing temperature set as a trigger for starting the initialization process has to be high enough to ensure that the time required for the initialization process falls within a necessary wait time period determined in view of the difference between the fixing temperature and a target fixing temperature and the rise rate of the temperature of the fixing roller. When a target temperature for the temperature adjustment for the fixing device is set to a target temperature suitable for the full color mode (including the ACS mode), the fixing temperature that allows starting of the initialization process (rotation of a motor for use in carrying out the jam detection process and the process for positioning or alignment of component units of the apparatus in preparation for image formation) is conventionally set to the same temperature between the BK monochrome mode and the full color mode in view of the target temperature in the full color mode, which is generally higher than that in the BK monochrome mode.

However, the target fixing temperature for the BK color is lower than that for the other colors, and the number of items of the BK adjustment process are fewer than the number of items of the color adjustment process so that time required for the BK adjustment process is shorter than time required for the color adjustment process. Therefore, in the present embodiment, in the step S1003, when the target temperature in the temperature adjustment for the fixing device in the BK monochrome mode is set to the target temperature for the BK monochrome, control is provided to delay the timing for starting the initialization process in the BK monochrome mode relative to that in the full color mode. As a result, in the BK monochrome mode, a time period over which electric power is supplied only for temperature adjustment for the fixing device can be set longer than in the full color mode, and the target temperature in the BK monochrome mode is lower than that in the full color mode, so that the wait time in the BK monochrome mode can be made shorter than that in the full color mode.

Therefore, the temperature to be reached by the fixing temperature for determining the timing for starting the initialization process including the image stabilization process is changed according to a set default color mode to be applied when the power is turned on, which makes it possible to drastically reduce the wait time. The above described control is executed by the CPU 301 of the control section 100.

FIG. 12 is a diagram showing examples of color mode-specific sets of items of the image stabilization process to be executed according to the set color mode when the power of the image forming apparatus is turned on.

As shown in FIG. 12, assuming that each color-specific image stabilization process is comprised of five items, in each of the image stabilization processes to be executed at startup in the full color mode and the ACS mode, respectively, it is necessary to execute twenty items (Dmax (Y/M/C/BK), Dhalf (Y/M/C/BK), primary ATVC (BK), primary ATVC (Y/M/C/BK), patch sensor-based density measurement and target correction (Y/M/C/BK), and developer (toner) density measurement and target correction (Y/M/C)) at the maximum. On the other hand, in the image stabilization process to be executed at startup in the BK monochrome mode, it is necessary to execute only four items (Dmax (BK), Dhalf (BK), primary ATVC (BK), and patch sensor-based density measurement and target correction (BK)), and therefore considerable reduction of the wait time is possible.

Next, a description will be given of a process (job input sequence) executed when a job is input in the standby state of the image forming apparatus, with reference to FIG. 11.

FIG. 11 is a flowchart of the process executed when a job is input in a standby state of the image forming apparatus. The process is executed by the CPU 301 of the control section 100 based on a control program. The term "4-color full color" is abbreviated as "4C" in FIG. 11.

As shown in FIG. 11, when a job is input in the standby state of the image forming apparatus, first, the CPU 301 determines in a step S1101 whether or not the default color mode is set to the BK monochrome mode, and whether or not the input job is color printing. If it is determined in the step S1101 that the default color mode is set to the BK monochrome mode and the input job is color printing, the process proceeds to a step S1105, wherein the CPU 301 refers to the full color (4C) initialization termination flag to determine whether or not the full color image stabilization process has been executed.

If the full color (4C) initialization termination flag has not been set in the step S1105, which means that only the BK-specific image stabilization process was executed upon power-on, the process proceeds to steps S1106 to S1110 so as to execute the full color image stabilization process. In the step S1106, the CPU 301 sets the target temperature to the fixing temperature for full color images, and then executes the image stabilization process for the four colors (Y/M/C/BK) including the BK color in a step S1107.

In the image stabilization process, similarly to the step S1008 in FIG. 10, the Dmax and Dhalf corrections as the image density control, the correction of patch image densities used in the ATR to respective target density values, and the primary ATVC are executed. In the primary ATVC, first, the BK monochrome image-forming sequence is executed to apply a predetermined voltage to the primary transfer roller 204 from the power supply and measure an electric current flowing at this time, to generate the primary transfer contrast voltage-current table (for the BK monochrome mode). Then, the full color image-forming sequence is executed to apply a predetermined voltage to the primary transfer roller 204 from the power supply and measure an electric current flowing at this time, to generate the primary transfer contrast voltage-current table (for the full color mode).

Then, in a step S1108, the CPU 301 sets the full color initialization termination flag to indicate that the full color image stabilization process has been executed. In the next step S1109, the CPU 301 carries out full color image formation according to the input job.

Thereafter, the CPU 301 determines in a step S1110 whether or not the job is all completed. If it is determined in the step S1110 that the job is all completed, the CPU 301 carries out post-rotation processing for the photosensitive drum 202, and then enters the standby state to normally terminate the job. If it is determined in the step S1110 that the job is not yet completed, the process returns to the step S1101, whereafter the CPU 301 repeatedly carries out the steps S1101 to S1110 until the job is all completed.

On the other hand, if at least one of the answers to the two questions of the step S1101, that is, whether or not the default color mode is set to the BK monochrome mode, and whether or not the input job is color printing, is negative (NO), it is judged that the default color mode is set to the full color mode, or the input job is BK monochrome printing.

When the default color mode is set to the full color mode, it means that the full color image stabilization process has been executed in the step S1008 in FIG. 10, and when the input job is BK monochrome printing, it means that the BK monochrome image stabilization process has been executed in the step S1005 in FIG. 10. Therefore, in either case, it is not necessary to execute the image stabilization process. In a step S1102, the CPU 301 determines whether or not the job is full color printing. If it is determined in the step S1102 that the job is full color printing, the process proceeds to a step S1103, wherein the CPU 301 carries out full color image formation. If it is determined in the step S1102 that the job is BK monochrome printing, the process proceeds to a step S1104, wherein the CPU 301 carries out BK monochrome image formation.

Thereafter, the CPU 301 determines in the step S1110 whether or not the job is all completed. If it is determined in the step S1110 that the job is all completed, the CPU 301 carries out post-rotation processing of the photosensitive drum 202, and then enters the standby state to terminate the job. If it is determined in the step S1110 that the job is not yet completed, the process returns to the step S1101, whereafter the CPU 301 repeatedly carries out the steps S1101 to S1110 until the job is all completed.

Although in the step S1107, the image stabilization process for the four colors including the BK color is executed, this is not limitative. More specifically, when the step S1107 is executed immediately after execution of the BK monochrome image stabilization process in the step S1005 in FIG. 10, then the environmental level should not change, and hence it is not necessary to execute the BK monochrome image stabilization process again. Therefore, execution of the image stabilization processes for the three colors other than BK color suffices.

As described above, according to the present embodiment, immediately after the power of the image forming apparatus is turned on, it is determined whether or not it is necessary to execute the image stabilization process for correcting image processing parameters corresponding to the set color mode. Then, if the image stabilization process needs to be executed, only the image stabilization process specific to the color required is selected according to the set color mode and executed. Thus, it suffices to execute correction of only a minimal number of necessary image processing parameters, so that the wait time before completion of process adjustment can be reduced. Further, since the image stabilization process is executed according to the set color mode, it is possible to ensure the quality of images to be printed out.

Although in the above described embodiment, the examples of color mode-specific sets of items of the image stabilization process executed according to the color mode set when the power of the image forming apparatus is turned on are shown in FIG. 12, the kinds and number of items of the image stabilization process are not limited to those shown in FIG. 2.

Further, in the above described embodiment, the black monochrome mode is described, by way of example, as a monochrome mode set at the startup of the power supply, but in the case where the developing section contains the four color toners, if any one of the Y, M, and C colors of the toners contained in the developing section is registered by default as the color of the monochrome mode, by executing only the image stabilization process specific to the registered color, the number of items thereof for execution can be also limited to five, whereby the wait time can be drastically reduced.

Furthermore, even when a 2-color mode or a 3-color mode is set as a default color mode at the startup of the power supply, only items for the image stabilization process for 2 colors or 3 colors need to be executed. In this case, a user can select the two or three colors from Y, M, C and BK colors, as desired, and register them via the operating section.

Similarly, in the case where the colors of toners contained in the developing section are six colors, i.e. the Y color, the M color, the C color, the BK color, a light Y color, and a light M color, when a 2-color mode, a 3-color mode, a 4-color mode, or a 5-color mode is set as a default color mode at the startup of the power supply, only items of the image stabilization process for 2 colors, 3 colors, 4 colors, or 5 colors are required to be executed. In this case, the user can select the two, three, four, or five colors from the Y, M, C, BK, light Y, and light M colors, as desired, and register them by operating the operating section.

The image formation in the ACS mode using six colors includes image formation using a single color (normally K) selected from six colors of Y, M, C, K, light Y, and light M, image formation using four colors of Y, M, C, and K (image formation in a 4-color mode), and image formation using six colors of Y, M, C, K, light Y, and light M (image formation in a 6-color mode). The three image formations are carried out by automatically recognizing image data. As default setting, one of the image formation in the 4-color mode and the image formation in the 6-color mode as the ACS mode can be set as the image formation in the ACS mode. The default setting may be carried out by depressing a user mode key on the operating section 303, selecting an item of ACS mode change from setting changeable items, not shown, and setting one of the 4-color mode and the 6-color mode as a default of the image formation in the ACS mode.

Thus, when the 4-color mode is set as the ACS mode, an image stabilization process for the four colors is executed in the 4-color mode, and when the 6-color mode is set as the ACS mode, an image stabilization process for the six colors is executed in the 6-color mode.

Although in the above described embodiment, the image forming apparatus according to the present invention is applied to a multi-function machine provided with the copying function, the printing function, and the facsimile function, this is not limitative, but it is possible to apply the image forming apparatus according to the present invention to a copying machine or a printer. When the image forming apparatus according to the present invention is applied to an image forming system including a printer, for example, the functions of the ACS key, the full color key, and the black and white key may be selected either on a host computer side or on a printer side. In this case, the function of the ACS key is to determine the type of image data and automatically output the image in color or in monochrome.

It is to be understood that the object of the present invention may also be accomplished by supplying a computer or a CPU with a program code (flowcharts in FIGS. 10 and 11) of software, which realizes the functions of the above described embodiment, and causing the computer or CPU to read out and execute the program code.

The above program has only to realize the functions of the above described embodiment on a computer, and the form of the program may be an object code, a program code executed by an interpreter, or script data supplied to an OS (Operating System.)

Further, it is to be understood that the object of the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program may be downloaded via a network from another computer, a database, or the like, not shown, connected to the Internet, a commercial network, a local area network, or the like.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

The present invention is not limited to the above described embodiment, but can be modified in various manners based on the subject matter of the present invention, which should not be excluded from within the scope of the present invention insofar as functions as recited in the appended claims or the functions performed by the construction of the above described embodiment can be achieved.

CROSS REFERENCE TO RELATED APPLICATION

This application claims priority from Japanese Patent Application No. 2004-056526 filed Mar. 1, 2004, which is hereby incorporated by reference herein.

What is claimed is:

1. An image forming apparatus comprising:

an image forming section that performs image formation using a plurality of developers having respective different predetermined colors, said image forming section having a first operation mode in which the image formation is carried out using only a predetermined one of the predetermined colors of the developers, a second operation mode in which the image formation is carried out using all of the predetermined colors of the developers, and a third operation mode in which the information is carried out in one of the first operation mode and the second operation mode selected by automatically recognizing image data;

a default setting section that sets one of the first operation mode, the second operation mode, and the third operation mode to a default mode to be applied when power of the image forming apparatus is turned on; and a controller that determines the default mode set by said default setting section when the power of the image forming apparatus is turned on, said controller being operable when the set default mode is the first operation mode, to cause an image stabilization process necessary for preparation of image formation to be executed only for the predetermined color used in the first operation mode, said controller being operable when the set default mode is the second operation mode or the third operation mode, to cause the image stabilization process necessary for preparation of image formation to be executed for all the predetermined colors which is to be used in the second operation mode.

2. An image forming apparatus as claimed in claim 1, wherein said controller determines when the power of the image forming apparatus is turned on whether or not the image stabilization process needs to be executed for preparation of image formation corresponding to the determined default mode, and when determining that the image stabilization process needs to be executed, causes the image stabilization process to be executed for the predetermined color or colors associated with the default mode.

3. An image forming apparatus as claimed in claim 1, wherein said controller determines when the power of the image forming apparatus is turned on whether or not the image stabilization process needs to be executed for preparation of image formation corresponding to the determined default mode, and when determining that the image stabilization process need not be executed, inhibits the image stabilization process from being executed for the predetermined color or colors associated with the default mode.

4. An image forming apparatus as claimed in claim 1, wherein in a case where the default mode set when the power of the image forming apparatus is turned on is the first operation mode, and thereafter, a job in the second operation mode is input, said controller causes the image stabilization process to be executed for all the predetermined colors including the predetermined color used in the first operation mode.

5. An image forming apparatus as claimed in claim 1, wherein the image stabilization process includes at least one of a maximum toner density correction process for maintaining a maximum toner density, a gradation correction process for maintaining halftone gradation characteristics, a toner density value correction process for maintaining a toner density at a target value, and a transfer high voltage setting process for setting a transfer high voltage for toner transfer.

6. An image forming apparatus as claimed in claim 1, wherein when the first operation mode is set to the default mode to be applied when the power of the image forming apparatus is turned on and a job in the second operation mode is input immediately after execution of the image stabilization process for the predetermined color used in the first operation mode, said controller causes the image stabilization process to be executed for the predetermined colors used in the second operation mode and other than the predetermined color used in the first operation mode.

7. An image forming apparatus comprising:

an image forming section that performs image formation using a plurality of developers having an N number (N=1, . . . , n: integer) of colors, respectively, said image forming section having a first operation mode in which the image formation is carried out using only a predetermined one (N=1) of the N number of colors of the developers, a second operation mode in which the image formation is carried out using all predetermined ones (N=n) of the N number of colors, a third operation mode in which the image formation is carried out in one of the first operation mode and the second operation mode is selected by automatically recognizing image data, and a fourth operation mode in which the image formation is carried out using an integer M number of colors out of the N number of colors of the developers, the integer being within a range of 1<M<n;

a default setting section that sets one of the first operation mode, the second operation mode, the third mode, and the fourth mode to a default mode to be applied when power of the image forming apparatus is turned on; and a controller that determines the default mode set by said default setting section when the power of the image forming apparatus is turned on, said controller being operable when the set default mode is the first operation mode, to cause an image stabilization process necessary for preparation of image formation to be executed only for the predetermined color used in the first operation mode, said controller being operable when the set default mode is the second operation mode or the third mode, to cause the image stabilization process necessary for preparation of image formation to be executed for all the predetermined colors used in the second operation mode, said controller being operable when the set default mode is the fourth mode, to cause the image stabilization process necessary for preparation of image formation to be executed for the integer M number (within the range of 1<M<n) of colors which is to be used in the fourth mode.

8. An image forming apparatus as claimed in claim 7, wherein the image stabilization process includes at least one of a maximum toner density correction process for maintaining a maximum toner density, a gradation correction process for maintaining halftone gradation characteristics, a toner density value correction process for maintaining a toner density at a target value, and a transfer high voltage setting process for setting a transfer high voltage for toner transfer.

9. An image forming apparatus comprising:

an image forming section that performs image formation using a plurality of developers having an N number (N=1, . . . , n: integer) of colors, respectively, said image forming section having a first operation mode in which the image formation is carried out using only a predetermined one (N=1) of the N number of colors of the developers, a second operation mode in which the image formation is carried out using all predetermined ones (N=n) of the N number of colors of the developers, a third operation mode in which the image formation is carried out using an integer M number of colors out of the N number of colors of the developers, the integer being within a range of 1<M<n, and a fourth mode in which the image formation is carried out in one of the first operation mode, the second operation mode, and the third operation mode is selected by automatically recognizing image data;

a default setting section that sets one of the first operation mode, the second operation mode, the third mode, and the fourth mode to a default mode to be applied when power of the image forming apparatus is turned on; and a controller that determines the default mode set by said default setting section when the power of the image forming apparatus is turned on, said controller being operable when the set default mode is the first operation mode, to cause an image stabilization process necessary for preparation of image formation to be executed only for the predetermined color used in the first operation mode, said controller being operable when the set default mode is the second operation mode, to cause the image stabilization process necessary for preparation of image formation to be executed for all the predetermined colors used in the second operation mode, said controller being operable when the set default mode is the third operation mode, to cause the image stabilization process necessary for preparation of image formation to be executed for the integer M number (within the range of 1<M<n) of colors which is to be used in the third operation mode, said controller being operable when the set default mode is the fourth operation mode, to cause the image stabilization process necessary for preparation of image formation to be executed for all the predetermined colors or the integer M number (within the range of 1<M<n) of colors which is to be used in the second operation mode or the third operation mode.

10. An image forming apparatus as claimed in claim 9, wherein said default setting section is capable of further setting one of the second operation mode and the third mode as the fourth mode.

11. An image forming apparatus as claimed in claim 9, wherein the image stabilization process includes at least one of a maximum toner density correction process for maintaining a maximum toner density, a gradation correction process for maintaining halftone gradation characteristics, a toner density value correction process for maintaining a toner density at a target value, and a transfer high voltage setting process for setting a transfer high voltage for toner transfer.

12. An image forming apparatus comprising:

an image forming section that performs image formation using a plurality of developers having respective different predetermined colors, said image forming section having a first operation mode in which the image formation is carried out using only a predetermined one of the predetermined colors of the developers, and a second operation mode in which the image formation is carried out using at least two of the predetermined colors;

a default setting section that sets one of the first operation mode or the second operation mode to a default mode to be applied when power of the image forming apparatus is turned on; and a controller that determines the default mode set by said default setting section when the power of the image forming apparatus is turned on, and determines whether or not an image stabilization process needs to be executed for preparation of image formation corresponding to the set default mode, said controller being operable when determining that the image stabilization process needs to be executed, to cause the image stabilization process to be executed for the predetermined color or colors associated with the default mode.

13. An image forming apparatus as claimed in claim 12, wherein the image stabilization process includes at least one of a maximum toner density correction process for maintaining a maximum toner density, a gradation correction process for maintaining halftone gradation characteristics, a toner density value correction process for maintaining a toner density at a target value, and a transfer high voltage setting process for setting a transfer high voltage for toner transfer.

14. An image forming apparatus as claimed in claim 12, wherein said image forming section further includes a third operation mode in which the image formation is carried out in one of the first operation mode and the second operation mode selected by automatically recognizing whether image to be output is in monochrome or in color.

15. An image forming apparatus comprising:

an image forming section that performs image formation using a plurality of developers having respective different predetermined colors, said image forming section having a first operation mode in which image formation is carried out using only a predetermined one of the predetermined colors of the developers, and a second operation mode in which the image formation is carried out using at least two of the predetermined colors of the developers;

a default setting section that sets one of the first operation mode or the second operation mode to a default mode to be applied when power of the image forming apparatus is turned on; and a controller that determines the default mode set by said default setting section when the power of the image forming apparatus is turned on, and determines whether or not an image stabilization process needs to be executed for preparation of image formation corresponding to the set default mode, said controller being operable when determining that the image stabilization process need not be executed, to inhibit the image stabilization process from being executed for the predetermined color or colors associated with the default mode.

16. An image forming apparatus as claimed in claim 15, wherein the image stabilization process includes at least one of a maximum toner density correction process for maintaining a maximum toner density, a gradation correction process for maintaining halftone gradation characteristics, a toner density value correction process for maintaining a toner density at a target value, and a transfer high voltage setting process for setting a transfer high voltage for toner transfer.

17. An image forming apparatus as claimed in claim 15, wherein said image forming section further includes a third operation mode in which the image formation is carried out in one of the first operation mode and the second operation mode selected by automatically recognizing whether image to be output is in monochrome or in color.

18. An image forming apparatus comprising:

an image forming section that performs image formation using a plurality of developers having respective different predetermined colors, said image forming section having a first operation mode in which image formation is carried out using only a predetermined one of the predetermined colors of the developers, and a second operation mode in which image formation is carried out using at least two of the predetermined colors of the developers;

a default setting section that sets one of the first operation mode or the second operation mode to a default mode to be applied when power of the image forming apparatus is turned on; and a controller that determines the default mode set by said default setting section when the power of the image forming apparatus is turned on, and determines timing for starting an image stabilization process for preparation of image formation for the predetermined color or colors associated with the default mode.

19. An image forming apparatus as claimed in claim 18, including a fixing section that carries out fixing, and wherein said controller monitors a fixing temperature of said fixing section, and said controller changes a value of the fixing temperature for determining the timing for starting the image stabilization process, depending on the default mode set when the power of the image forming apparatus is turned on.

20. An image forming apparatus as claimed in claim 18, wherein the image stabilization process includes at least one of a maximum toner density correction process for maintaining a maximum toner density, a gradation correction process for maintaining halftone gradation characteristics, a toner density value correction process for maintaining a toner density at a target value, and a transfer high voltage setting process for setting a transfer high voltage for toner transfer.

21. An image forming apparatus as claimed in claim 18, wherein said image forming section further includes a third operation mode in which the image formation is carried out in one of the first operation mode and the second operation mode selected by automatically recognizing whether image to be output is in monochrome or and image formation is carried out in the selected mode.

22. An image stabilization processing method for an image forming apparatus, comprising:

an image forming step of performing image formation using a plurality of developers having respective different predetermined colors, said image forming step having a first operation mode in which the image formation is carried out using only a predetermined one of the predetermined colors of the developers, a second operation mode in which image formation is carried out using all of the predetermined colors, and a third operation mode in which the image formation is carried out in one of the first operation mode and the second operation mode selected by automatically recognizing image data;

a default setting step of setting one of the first operation mode, the second operation mode, and the third mode to a default mode to be applied when power of the image forming apparatus is turned on; and an executing step of determining the default mode set in said default setting step when the power of the image forming apparatus is turned on, causing an image stabilization process necessary for preparation of image formation to be executed only for the predetermined color used in the first operation mode when the set default mode is the first operation mode, and causing the image stabilization process necessary for preparation of image formation to be executed for all the predetermined colors used in the second operation mode when the set default mode is the second operation mode or the third operation mode.

23. An image stabilization processing method for an image forming apparatus, comprising:

an image forming step of performing image formation using a plurality of developers having a number (N=1, . . . , n: integer) of colors, respectively, said image forming step having a first operation mode in which the image formation is carried out using only a predetermined one (N=1) of the N number of colors of the developers, a second operation mode in which the image formation is carried out using all predetermined ones (N=n) of the N number of colors of the developers, a third operation mode in which the image formation is carried out in one of the first operation mode and the second operation mode is selected by automatically recognizing image data, and a fourth operation mode in which image formation is carried out using an integer M number of colors out of the N number of colors of the developers, the integer being within a range of 1<M<n;

a default setting step of setting one of the first operation mode, the second operation mode, the third mode, and the fourth mode to a default mode to be applied when power of the image forming apparatus is turned on; and an executing step of determining the default mode set in said default setting step when the power of the image forming apparatus is turned on, causing an image stabilization process necessary for preparation for image formation to be executed only for the predetermined color which is to be used in the first operation mode when the set default mode is the first operation mode, causing the image stabilization process necessary for preparation of image formation to be executed for all the predetermined colors which is to be used in the second operation mode when the set default mode is the second operation mode or the third operation mode, and causing the image stabilization process necessary for preparation of image formation to be executed for the integer M number (within the range of 1<M<n) of colors which is to be used in the fourth mode when the set default mode is the fourth operation mode.

24. An image stabilization processing method for an image forming apparatus, comprising:

an image forming step of performing image formation using a plurality of developers having an N number (N=1, . . . , n: integer) of colors, respectively, said image forming step having a first operation mode in which the image formation is carried out using only a predetermined one (N=1) of the N number of colors of the developers, a second operation mode in which the image formation is carried out using all predetermined ones (N=n) of the N number of colors of the developers, a third operation mode in which the image formation is carried out using an integer M number of colors out of the N number of colors of the developers, the integer being within a range of 1<M<n, and a fourth mode in which the image formation is carried out in one of the first operation mode, the second operation mode, and the third operation mode is selected by automatically recognizing image data;

a default setting step of setting one of the first operation mode, the second operation mode, the third operation mode, and the fourth operation mode to a default mode to be applied when power of the image forming apparatus is turned on; and an executing step of determining the default mode set in said default setting step when the power of the image forming apparatus is turned on, causing an image stabilization process necessary for preparation for image formation to be executed only for the predetermined color used in the first operation mode when the set default mode is the first operation mode, causing the image stabilization process necessary for preparation of image formation to be executed for all the predetermined colors which is to be used in the second operation mode when the set default mode is the second operation mode, causing the image stabilization process necessary for preparation of image formation to be executed for the integer M number (within the range of 1<M<n) of colors which is to be used in the third operation mode when the set default mode is the third operation mode, and causing the image stabilization process necessary for preparation of image formation to be executed for all the predetermined colors or the integer M number (within the range of 1<M<n) of colors which is to be used in the second operation mode or the third operation mode.

25. An image stabilization processing method for an image forming apparatus, comprising:

an image forming step of performing image formation using a plurality of developers having respective different predetermined colors, said image forming step having a first operation mode in which the image formation is carried out using only a predetermined one of the predetermined colors of the developers, and a second operation mode in which the image formation is carried out using at least two of the predetermined colors of the developers;

a default setting step of setting one of the first operation mode or the second operation mode to a default mode to be applied when power of the image forming apparatus is turned on; and an executing step of determining the default mode set in said default setting step when the power of the image forming apparatus is turned on, determining whether or not an image stabilization process needs to be executed for preparation of image formation corresponding to the set default mode, and causing the image stabilization process to be executed for the predetermined color or colors associated with the default mode when it is determined that the image stabilization process needs to be executed.

26. An image stabilization processing method for an image forming apparatus, comprising:

an image forming step of performing image formation using a plurality of developers having respective different predetermined colors, said image forming step having a first operation mode in which the image formation is carried out using only a predetermined one of the predetermined colors of the developers, and a second operation mode in which the image formation is carried out using at least two of the predetermined colors;

a default setting step of setting one of the first operation mode or the second operation mode to a default mode to be applied when power of the image forming apparatus is turned on; and an executing step of determines the default mode set in said default setting step when the power of the image forming apparatus is turned on, determining whether or not an image stabilization process needs to be executed for preparation for image formation corresponding to the set default mode, and inhibiting the image stabilization process from being executed for the predetermined color or colors associated with the default mode when determining that the image stabilization process need not be executed.

27. An image stabilization processing method for an image forming apparatus, comprising:

an image forming step of performing image formation using a plurality of developers having respective different predetermined colors, said image forming step having a first operation mode in which the image formation is carried out using only a predetermined one of the predetermined colors of the developers, and a second operation mode in which the image formation is carried out using at least two of the predetermined colors;

a default setting step of setting one of the first operation mode or the second operation mode to a default mode to be applied when power of the image forming apparatus is turned on; and an executing step of determining the default mode set in said default setting step when the power of the image forming apparatus is turned on, and determining timing for starting an image stabilization process for preparation of image formation for the predetermined color or colors associated with the default mode.

* * * * *